United States Patent [19]

Campbell et al.

[11] 4,171,964

[45] Oct. 23, 1979

[54] HYDROCARBON GAS PROCESSING

[75] Inventors: Roy E. Campbell; John D. Wilkinson; Carroll L. Rambo, all of Midland, Tex.

[73] Assignee: The Ortloff Corporation, Midland, Tex.

[21] Appl. No.: 728,962

[22] Filed: Oct. 4, 1976

Related U.S. Application Data

[63] Continuation-in-part of Ser. No. 712,825, Aug. 9, 1976, which is a continuation-in-part of Ser. No. 698,025, Jun. 21, 1976.

[51] Int. Cl.[2] ..... F25J 3/02

[52] U.S. Cl. ..... 62/24; 62/28; 62/38

[58] Field of Search ..... 62/23, 27, 28, 38, 39, 62/44

[56] References Cited

U.S. PATENT DOCUMENTS

| | | | |
|---|---|---|---|
| 2,903,858 | 9/1959 | Bocquet | 62/38 |
| 2,915,880 | 12/1959 | Schuftan et al. | 62/38 |
| 3,277,655 | 10/1966 | Geist et al. | 62/39 |
| 3,292,380 | 12/1966 | Bucklin | 62/38 |
| 3,490,246 | 1/1970 | Becker | 62/38 |

*Primary Examiner*—Norman Yudkoff
*Attorney, Agent, or Firm*—Brumbaugh, Graves, Donohue & Raymond

[57] ABSTRACT

The processing of gas streams containing hydrocarbons and other gases of similar volatility to recover high yields of components such as ethane, propane, and heavier hydrocarbons therefrom by cooling said gas stream under pressure to form a liquid portion, and expanding the liquid portion to a pressure lower than feed pressure whereby a part of the liquid portion vaporizes to cool the remaining part of the liquid portion is improved by pre-cooling the liquid portion prior to flash expansion. In one embodiment this is accomplished by dividing the remaining part of the liquid portion into a first and second stream, directing the first liquid stream into heat exchange relation with the liquid portion of the feed stream prior to expansion to warm the first liquid stream and pre-cool the liquid portion prior to expansion. Both first and second liquid streams are then supplied to a fractionating column, the second stream being supplied to the fractionating column at a point thereon higher than the first stream. Several other methods of pre-cooling the liquid portion are also described.

22 Claims, 16 Drawing Figures

(PRIOR ART, FIG. 2)

(PROCESS OF EX. 8, FIG. 10)

HYDROCARBON GAS PROCESSING

This is a continuation-in-part of our co-pending application, Ser. No. 712,825 filed Aug. 9, 1976. Said application, Ser. No. 712,825, was in turn a continuation-in-part of our application, Ser. No. 698,025 filed June 21, 1976.

This invention relates to the processing of gas streams containing hydrocarbons and other gases of similar volatility to remove desired condensable fractions. In particular, the invention is concerned with processing of gas streams such as natural gas, synthetic gas and refinery gas streams to recover most of the propane and a major portion of the ethane content thereof together with substantially all of the heavier hydrocarbon content of the gas.

Gas streams containing hydrocarbons and other gases of similar volatility which may be processed according to the present invention include natural gas, synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. There may also be lesser amounts of the relatively heavier hydrocarbons such as propane, butanes, pentanes, and the like, as well as $H_2$, $N_2$, $CO_2$ and other gases. A typical analysis of a natural gas stream to be processed in accordance with the invention would be, in approximate mole %, 80% methane, 10% ethane, 5% propane, 0.5% iso-butane, 1.5% normal butane, 0.25% iso-pentane, 0.25% normal pentane, 0.5% hexane plus, with the balance made up of nitrogen and carbon dioxide. Sulfur containing gases are also often found in natural gas.

Recent substantial increases in the market for the ethane and propane components of natural gas has provided demand for processes yielding higher recovery levels of these products. Available processes for separating these materials include those based upon cooling and refrigeration of gas, oil absorption, refrigerated oil absorption, and the more recent cryogenic processes utilizing the principle of gas expansion through a mechanical device to produce power while simultaneously extracting heat from the system. Depending upon the pressure of the gas source, the richness (ethane and heavier hydrocarbons content) of the gas and the desired end products, each of these prior art processes or a combination thereof may be employed.

The cryogenic expansion type recovery process is now generally preferred for ethane recovery because it provides maximum simplicity with ease of start up, operating flexibility, good efficiency, safety, and good reliability. U.S. Pat. Nos. 3,360,944, 3,292,380, and 3,292,381 describe relevant processes.

In a typical cryogenic expansion type recovery process a feed gas stream under pressure is cooled by heat exchange with other streams of the process and/or external sources of cooling such as a propane compression-refrigeration system. As the gas is cooled, liquids are condensed and are collected in one or more separators as a high-pressure liquid feed containing most of the desired $C_2+$ components. The high-pressure liquid feed is then expanded to a lower pressure. The vaporization occurring during expansion of the liquid results in further cooling of the remaining portion of the liquid. The cooled stream, comprising a mixture of liquid and vapor, is demethanized in a demethanizer column. The demethanizer is a fractionating column in which the expansion-cooled stream is fractionated to separate residual methane, nitrogen and other volatile gases as overhead vapor from the desired products of ethane, propane and heavier components as bottom products.

If the feed stream is not totally condensed, typically it is not, the vapor remaining from this partial condensation is passed through a turbo-expander, or expansion valve, to a lower pressure. Additional liquids are condensed as a result of the further cooling of the stream by expansion. The pressure after the expansion is usually the same pressure at which the demethanizer is operated. Liquid thus obtained is also supplied as a feed to the demethanizer. Typically, the remaining vapor and demethanizer overhead vapor are combined as the residual methane product gas.

In the ideal operation of such a separation process the overhead vapors leaving the process will contain substantially all of the methane found in the feed gas to the recovery plant, and substantially no hydrocarbons equivalent to ethane or heavier components. The bottoms fraction leaving the demethanizer will contain substantially all of the heavier components and essentially no methane. In practice, however, this ideal situation is not obtained largely for the reason that the conventional demethanizer is operated largely as a stripping column. The methane product in the process, therefore, typically comprises vapors leaving the top fractionation stage of the column together with vapors not subjected to any rectification step. Substantial losses of ethane occur because the vapors remaining from low temperature separation steps contain ethane and heavier components which could be recovered if those vapors could be brought to lower temperatures or if they were brought in contact with a significant quantity of relatively heavy hydrocarbons, for example, $C_3$ and heavier, capable of absorbing the ethane. Overall recovery of ethane can be further increased by altering the temperature distribution in the demethanizer column so as to decrease the temperature at the upper stages of the column by removing heat from one or more of the feeds thereto. The present invention provides the means for achieving either or both of the objectives that significantly increase the yield of desired products.

For a better understanding of the present invention reference is made to the following examples and drawings.

Referring to the drawings.

In the following explanation of the above figures, tables are provided summarizing flow rates, calculated for representative processing conditions. In the tables, the values for flow rates (in pound moles per hour) have been rounded to the nearest whole number for convenience. The total stream flow rates shown in the tables include all nonhydrocarbon components, and are generally larger than the sum of the stream flow rates for hydrocarbon components. Temperatures indicated are approximate values rounded to the nearest degree.

Figure 1:
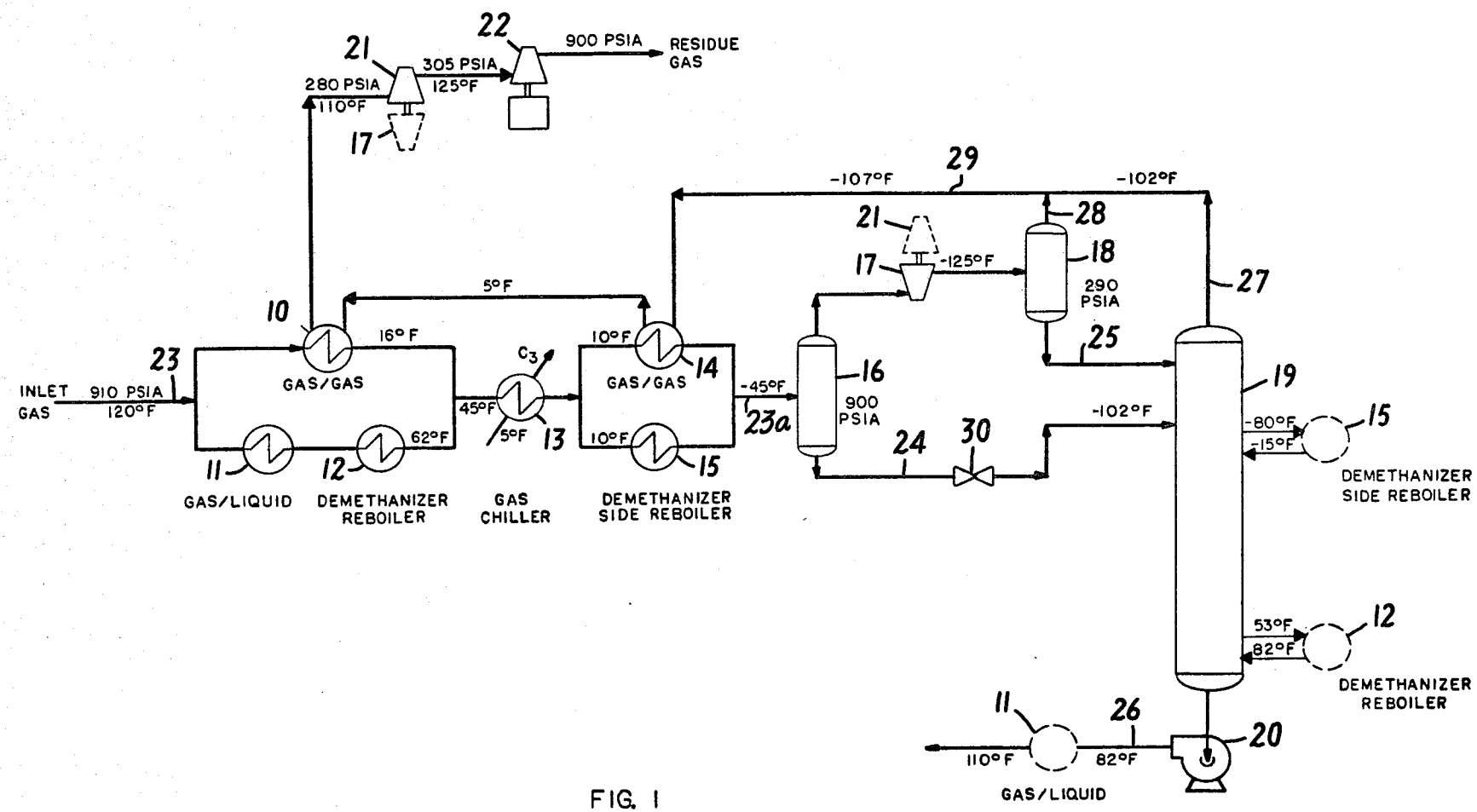
FIG. 1 PRIOR ART
FIG. 1 is a flow diagram of a single-stage cryogenic expander natural gas processing plant of the prior art incorporating a set of conditions for a typical rich natural gas stream.

Referring to FIG. 1, plant inlet gas from which carbon dioxide and sulfur compounds have been removed (if the concentration of these compounds in the plant inlet gas would cause the product stream not to meet specifications, or cause icing in the equipment), and which has been dehydrated, enters the process at 120° F. and 910 psia at stream 23. It is then divided into two parallel streams and is cooled to 45° F. by heat exchange with cool residue gas at 5° F. in exchanger 10; with product liquids (stream 26) at 82° F. in exchanger 11; and with demethanizer liquid at 53° F. in demethanizer reboiler 12. From these exchangers, the streams recombine and enter the gas chiller, exchanger 13, where the combined stream is cooled to 10° F. with propane refrigerant at 5° F. The cooled stream is again divided into two parallel streams, and further chilled by heat exchange with cold residue gas (stream 29) at −107° F. in exchanger 14, and with demethanizer liquids at −80° F. in demethanizer side reboiler 15. The streams recombine (stream 23*a*) and enter a high-pressure separator 16 at −45° F. and 900 psia. The condensed liquid, stream 24, is separated and fed to the demethanizer 19 through expansion valve 30. An expansion engine may be used in place of the expansion valve 30 if desired.

The cooled gas from the high-pressure separator 16 flows through expander 17 where it is work expanded from 900 psia to 290 psia. The work expansion chills the gas to −125° F. Expander 17 is preferably a turbo-expander, having a compressor 21 mounted on the expander shaft. For convenience, expander 17 is sometimes hereinafter referred to as the expansion means. In certain prior art embodiments, expander 17 is replaced by a conventional expansion valve.

Liquid condensed during expansion is separated in low pressure separator 18. The liquid is fed on level control through line 25 to the demethanizer column 19 at the top and flows from a chimney tray (not shown) as top feed to the column 19.

It should be noted that in certain embodiments low pressure separator 18 may be included as part of demethanizer 19, occupying the top section of the column. In this case, the expander outlet stream enters above a chimney tray at the bottom of the separator section, located at the top of the column. The liquid then flows from the chimney tray as top feed to the demethanizing section of the column.

As liquid fed to demethanizer 19 flows down the column, it is contacted by vapors which strip the methane from the liquid to produce a demethanized liquid product at the bottom. The heat required to generate stripping vapors is provided by heat exchangers 12 and 15.

The vapors stripped from the condensed liquid in demethanizer 19 exit through line 27 to join the cold outlet gas from separator 18 via line 28. The combined vapor stream then flows through line 29 back through heat exchangers 14 and 10. Following these exchangers, the gas flows through compressor 21 driven by expander 17 and directly coupled thereto. Compressor 21 compresses the gas to a discharge pressure of about 305 psia. The gas then enters compressor 22 and is compressed to a final discharge pressure of 900 psia.

Inlet and liquid component flow rates, outlet liquid recoveries and compression requirements for this prior art process shown in FIG. 1 are given in the following table:

TABLE I

| Stream Flow Rate Summary - Lb. Moles/Hr. | | | | | |
|---|---|---|---|---|---|
| Stream | Methane | Ethane | Propane | Butanes+ | Total |
| 23 | 1100 | 222 | 163 | 130 | 1647 |
| 24 | 795 | 202 | 157 | 129 | 1300 |
| 25 | 16 | 10 | 5 | 1 | 32 |
| 26 | 3 | 162 | 157 | 130 | 453 |
| Recoveries | | | | | |
| Ethane | | 72.9% | | 29,296 Gal/Day | |
| Propane | | 96.2% | | 39,270 Gal/Day | |
| Compression Horsepower | | | | | |
| Refrigeration | | | | 256 BHP | |
| Recompression | | | | 892 BHP | |
| | | | Total | 1148 BHP | |

Figure 2:
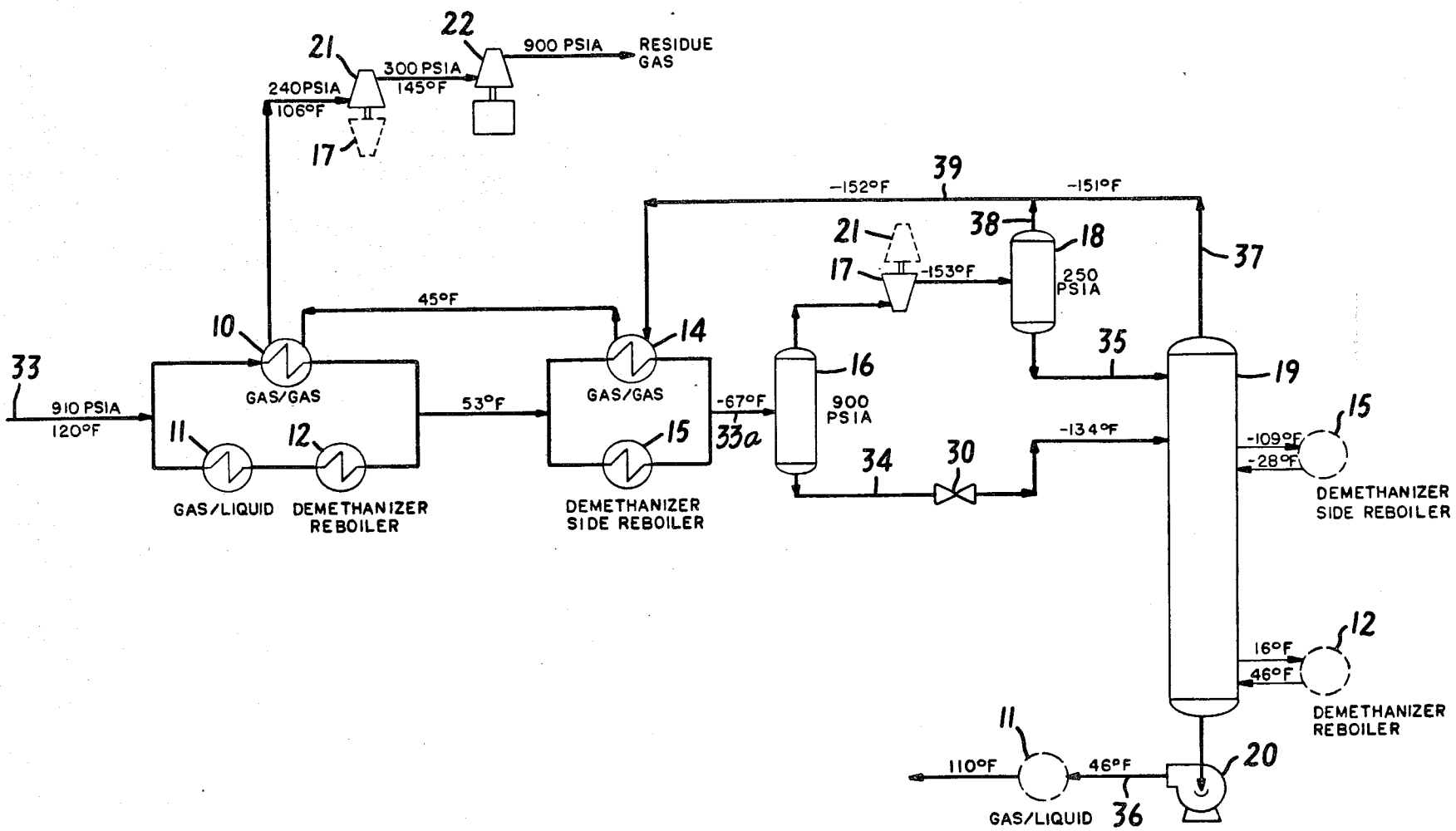
FIG. 2 PRIOR ART
FIG. 2 is a flow diagram of a single-stage cyrogenic expander natural gas processing plant of the prior art incorporating a set of conditions for a typical lean natural gas stream.

In FIG. 2 a typical lean natural gas stream 33 is processed and cooled using a prior art process similar to that shown in FIG. 1. The inlet gas stream is cooled to −67° F. at 900 psia (33*a*) and flows to high-pressure separator 16 where the liquid contained therein is separated and fed on level control through line 34 and expansion valve 30 to demethanizer 19 in the middle of the column.

Cold gas from separator 16 flows through expander 17 where because of work expansion from 900 psia to 250 psia, the gas is chilled to −153° F. The liquid condensed during expansion is separated in low pressure separator 18 and is fed on level control through line 35 to the demethanizer 19 as top feed to the column.

The data for this case are given in the following table:

TABLE II (FIG. 2)

| Stream | Methane | Ethane | Propane | Butanes+ | Total |
|---|---|---|---|---|---|
| | Stream Flow Rate Summary - Lb. Moles/Hr. | | | | |
| 33 | 1447 | 90 | 36 | 43 | 1647 |
| 34 | 280 | 42 | 25 | 39 | 391 |
| 35 | 133 | 35 | 11 | 4 | 186 |
| 36 | 2 | 71 | 36 | 43 | 155 |
| Recoveries | | | | | |
| Ethane | | 79.0% | | 17,355 Gal/Day | |
| Propane | | 98.2% | | 8,935 Gal/Day | |
| Compression Horsepower | | | | | |
| Refrigeration | | | | 0 BHP | |
| Recompression | | | | 1180 BHP | |
| | | | Total | 1180 BHP | |

In the prior art cases discussed with respect to FIG. 1 and FIG. 2 above, recoveries of ethane are 73% for the case of the rich gas feed and 79% for the lean gas feed. It is recognized that some improvement in yield may result by adding one or more cooling steps followed by one or more separation steps, or by altering the temperature of separator 16 or the pressure in separator 18. Recoveries of ethane and propane obtained in this manner, while possibly improved over the cases illustrated by FIG. 1 and FIG. 2, are significantly less than yields which can be obtained in accordance with the process of the present invention.

In accordance with the embodiments of the invention to be described in Examples 1 to 5, the hydrocarbon gas, under pressure, is cooled sufficiently to form a liquid portion, and the liquid portion is expanded to a lower pressure as in the conventional process. Expansion of the first part of the liquid portion vaporizes a portion of it and cools the remaining part, which remains as a liquid. This expanded stream usually is supplied to a fractionation column where it is separated into a top fraction and a bottom fraction. In the present invention, the foregoing process is improved by dividing the remaining part of the liquid portion into first and second liquid streams. The first liquid stream is diverted in heat exchange relation with the liquid portion of the feed stream prior to expansion to pre-cool or sub-cool the liquid portion prior to expansion. The pre-cooling (or synonymously sub-cooling) of the liquid portion condensed from the feed gas under pressure prior to expansion reduces the temperature attained by the aforementioned second liquid stream after expansion.

The first and second liquid streams are then supplied to the fractionating column. The second liquid stream is supplied to the column at a point higher on the column than the first liquid stream.

EXAMPLE 1

Figure 3:
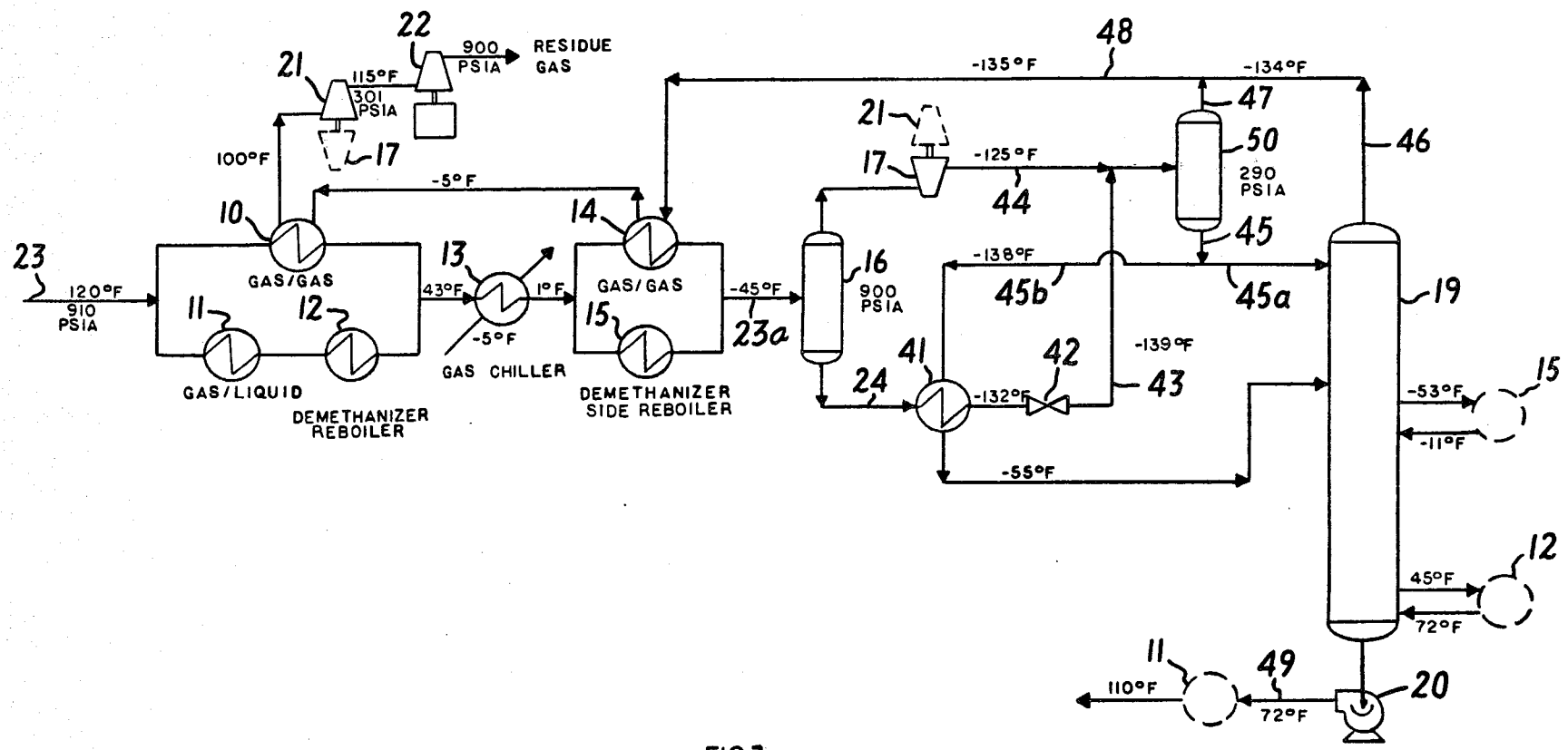
FIG. 3 is a flow diagram showing one embodiment of the present invention wherein the liquids from the high-pressure separator are sub-cooled and then combined with the expander outlet stream to pass to the demethanizer.

One embodiment of the process of the present invention is shown in FIG. 3. Prior art processes are used to remove sulfur containing compounds, carbon dioxide and to dehydrate and cool the inlet gas 23° to −45° F., generally as described in FIG. 1, by heat exchangers 10, 11, 12, 13, 14 and 15. As in FIG. 1, the process conditions stated in FIG. 3, as well as flow rates in Table III below, are for the case of a rich feed gas. The cooled and partially condensed gas **23*a* at −45° F. and 900 psia flows to high-pressure separator 16** where condensed liquid therein is separated.

The cooled gas component of the inlet stream flows from high-pressure separator 16 through expander 17 where, because of work expansion from 900 psia to 290 psia, the gas is chilled to −125° F. As in the prior art process shown in FIG. 1, expander 17 may have a compressor 21 mounted on the expander shaft. The expander outlet stream 44 is then combined with the cold stream 43, from valve 42 as it flows to low pressure separator 50.

The cooled liquid from high-pressure separator 16, stream 24, flows through exchanger 41 where it is sub-cooled to −132° F. by heat exchange with a portion of the cold liquids from low pressure separator 50, as described below. The sub-cooled liquids then undergo expansion and flash vaporization at valve 42 as the pressure is reduced to 290 psia. The cold stream, 43, from valve 42, then combines with expander outlet stream 44, as explained above.

A first part of the condensed liquid from separator 50 flows as stream **45*a* to the top of demethanizer 19 as top feed to the column. The second part, stream 45*b*, of liquid from separator 50 flows through exchanger 41 where it is used to sub-cool the liquids from high pressure separator 16. From exchanger 41, the stream flows to demethanizer 19** as feed in the middle of the column.

The vapor stripped from the condensed liquid in demethanizer 19 leaves through line 46 to join the cold outlet vapor 47 from separator 18, and the combined stream flows through line 48 through the balance of the system.

Component flow rates, liquid recoveries and compression requirements for this embodiment are given in the following table:

TABLE III (FIG. 3)

| Stream | Methane | Ethane | Propane | Butanes+ | Total |
|---|---|---|---|---|---|
| | Stream Flow Rate Summary - Lb. Moles/Hr. | | | | |
| 23 | 1100 | 222 | 163 | 130 | 1647 |
| 24 | 795 | 202 | 157 | 129 | 1300 |
| 49 | 5 | 204 | 161 | 130 | 501 |
| Recoveries | | | | | |
| Ethane | | 92.1% | | 49,647 Gal/Day | |
| Propane | | 98.8% | | 40,333 Gal/Day | |
| Compression Horsepower | | | | | |
| Refrigeration | | | | 384 BHP | |
| Recompression | | | | 840 BHP | |
| | | | Total | 1224 BHP | |

EXAMPLE 2

Figure 4:
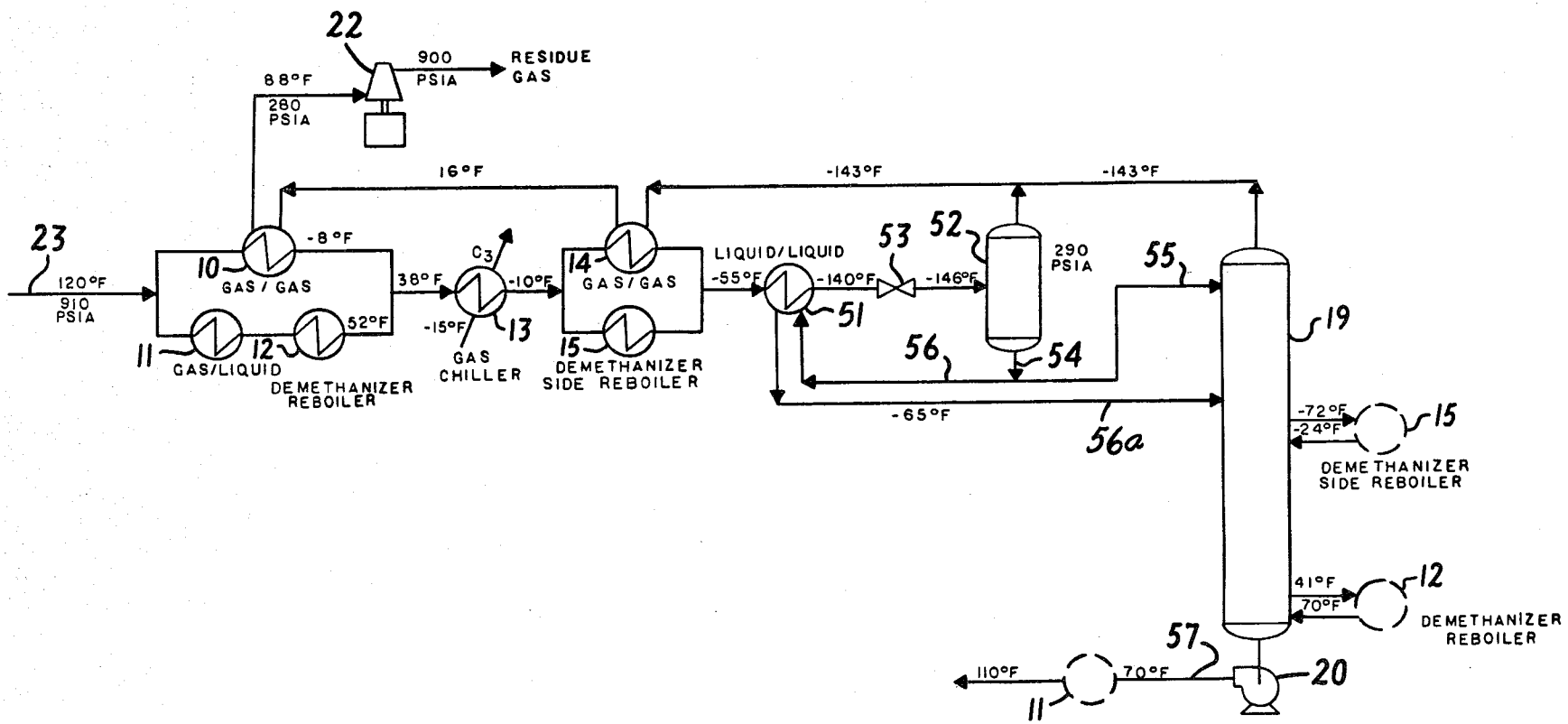
FIG. 4 is a flow diagram showing an embodiment of the present invention wherein the inlet stream is totally condensed and sub-cooled before passing to the demethanizer.

A second embodiment of the process of the present invention is shown in FIG. 4. In this embodiment, inlet gas 23 is processed and cooled through heat exchangers 10, 11, 12, 13 and 14 and reboiler 15. As in FIG. 1, process conditions and flow rates in the table below are for a rich feed gas. However, in contrast to FIG. 1, the feed gas in this case is cooled to −55° F., at which temperature the entire inlet gas stream is condensed. The condensed liquids then enter exchanger 51 wherein they are further cooled to −140° F. by heat exchange with a portion of the cold liquid stream from low pressure separator 52. From exchanger 51, the cooled inlet stream undergoes expansion and flash vaporization through expansion valve 53. From valve 53, the cold inlet stream enters low pressure separator 52 where the vapor and liquid portions therein are separated.

A first part of the cold liquids 54 from low pressure separator 53, stream 55, enters the demethanizer as top feed to the column. The second part 56 of the liquid from separator 52 flows to exchanger 51 where it is used to cool inlet gas from −55° F. to −140° F. From exchanger 51, the stream 56a is fed to demethanizer 19 in the middle of the column.

The data for this case are given in the following table:

TABLE IV (FIG. 4)

| Stream | Methane | Ethane | Propane | Butanes+ | Total |
|---|---|---|---|---|---|
| | Stream Flow Rate Summary - Lb. Moles/Hr. | | | | |
| 23 | 1100 | 222 | 163 | 130 | 1647 |
| 54 | 1109 | 221 | 163 | 130 | 1544 |
| 57 | 5 | 210 | 162 | 130 | 509 |
| Recoveries | | | | | |
| Ethane | | 94.8% | | 51,065 Gal/Day | |
| Propane | | 99.1% | | 40,455 Gal/Day | |
| Compression Horsepower | | | | | |
| Refrigeration | | | | 457 BHP | |
| Recompression | | | | 871 BHP | |
| | | | Total | 1328 BHP | |

EXAMPLE 3

Figure 5:
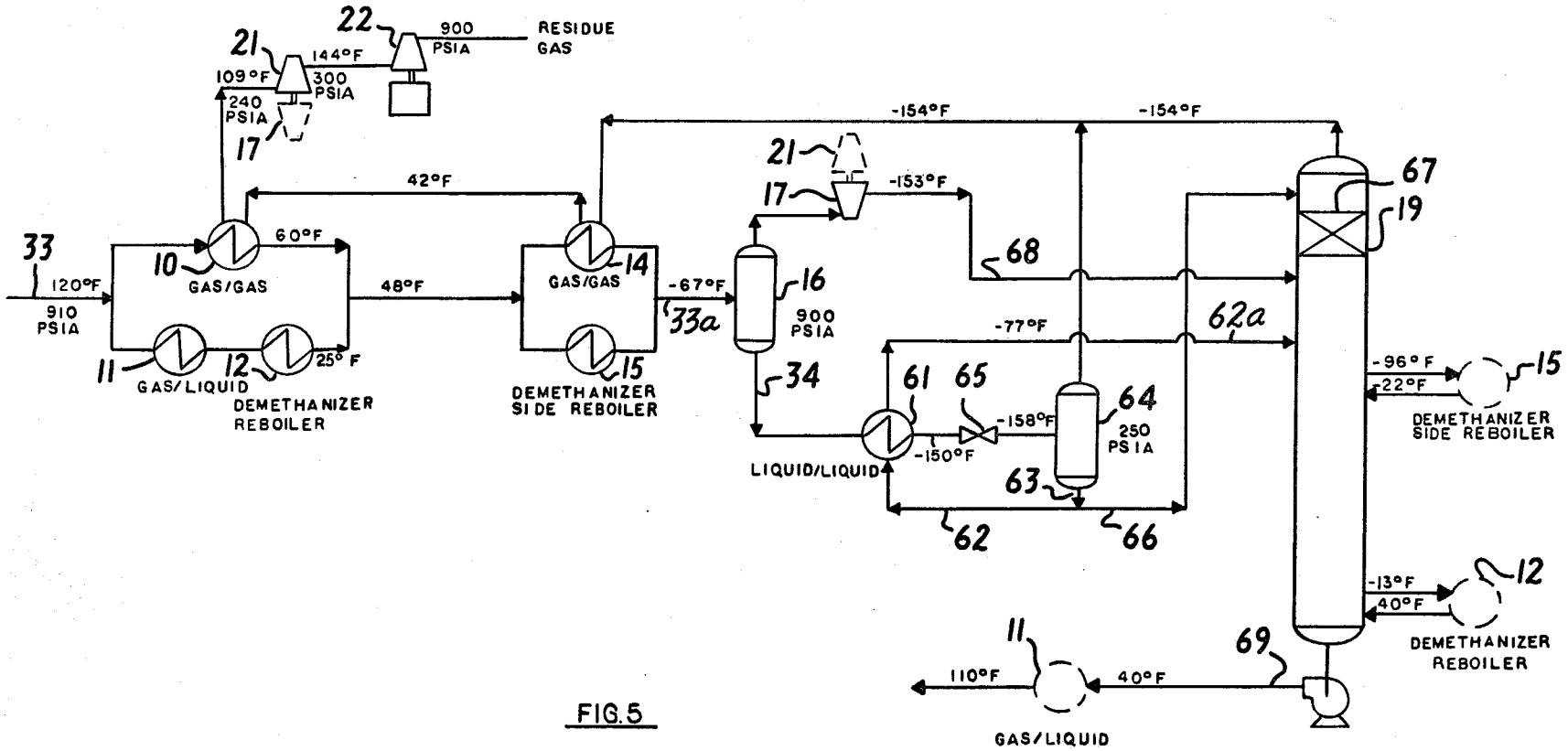
FIG. 5 is a flow diagram showing an embodiment of the present invention wherein the liquids from the high-pressure separator are sub-cooled and fed to the demethanizer above the expander outlet stream.

A third embodiment of the process of the present invention is shown in FIG. 5. The prior art process shown in FIG. 2 is used to cool the inlet gas in the line following exchanger 14 and reboiler 15 to −67° F. at 900 psia, 33a. As in FIG. 2, the process conditions given, and flow rates set forth below in Table V are for a lean feed gas. The gas at −67° F. flows to high-pressure separator 16 where condensed liquid therein is separated.

The cooled vapor from separator 16 flows through expander 17 where because of work expansion from 900 psia to 250 psia, it is chilled to −153° F. From expander 17 the chilled vapor stream flows to demethanizer 19 as its middle feed.

The liquid 34 from separator 16 flows through exchanger 61 where it is sub-cooled to −150° F. by heat exchange with a first part 62 of the cold liquids 63 from low pressure separator 64. The sub-cooled liquid then undergoes expansion and flash vaporization at valve 65 as pressure is reduced to 250 psia. The cold stream from expansion valve 65 flows to separator 64 where the cold liquid and vapor are separated.

As mentioned above, the first part 62 of the liquid from separator 64 is used to sub-cool condensed liquid 34 from the high pressure separator 16. Stream 62 then flows to demethanizer 19 as its lowest feed. The second part 66 of the liquid from separator 64 is supplied to demethanizer 19 as the top feed.

Demethanizer 19 shows, at 67, an area which represents trays or packing equivalent to at least one distillation stage. In this embodiment, an interval of packing or of trays is provided sufficient to insure that ethane and higher hydrocarbons contained in the mixture of vapor and liquid in the feed 68 from expander 17, mixes in the column with top feed liquids rich in heavier hydrocarbons during their passage through area 67 of the demethanizer, and that the mixing take place under conditions which aid maximum recovery of ethane and the higher hydrocarbons. These favorable conditions include a top feed that is rich in higher hydrocarbons, as in stream 66, and column design considerations which provide that warmer streams to the column, as stream 62a, are spaced sufficiently below the top feed that in operation, the vapor temperature of the column in the area adjacent to the top feed will closely approach the temperature of the top feed stream.

The data for this case are given in the following table:

TABLE V (FIG. 5)

| Stream | Methane | Ethane | Propane | Butane+ | Total |
|---|---|---|---|---|---|
| | Stream Flow Rate Summary - Lb. Moles/Hr. | | | | |
| 33 | 1447 | 90 | 36 | 43 | 1647 |
| 34 | 280 | 42 | 25 | 39 | 391 |
| 63 | 251 | 42 | 25 | 39 | 361 |
| 69 | 2 | 79 | 36 | 43 | 164 |
| Recoveries | | | | | |
| Ethane | | 87.6% | | 19,240 Gal/Day | |
| Propane | | 97.6% | | 8,883 Gal/Day | |
| Compression Horsepower | | | | | |
| Refrigeration | | | | 0 BHP | |
| Recompression | | | | 1181 BHP | |
| | | | Total | 1181 BHP | |

EXAMPLE 4

Figure 6:
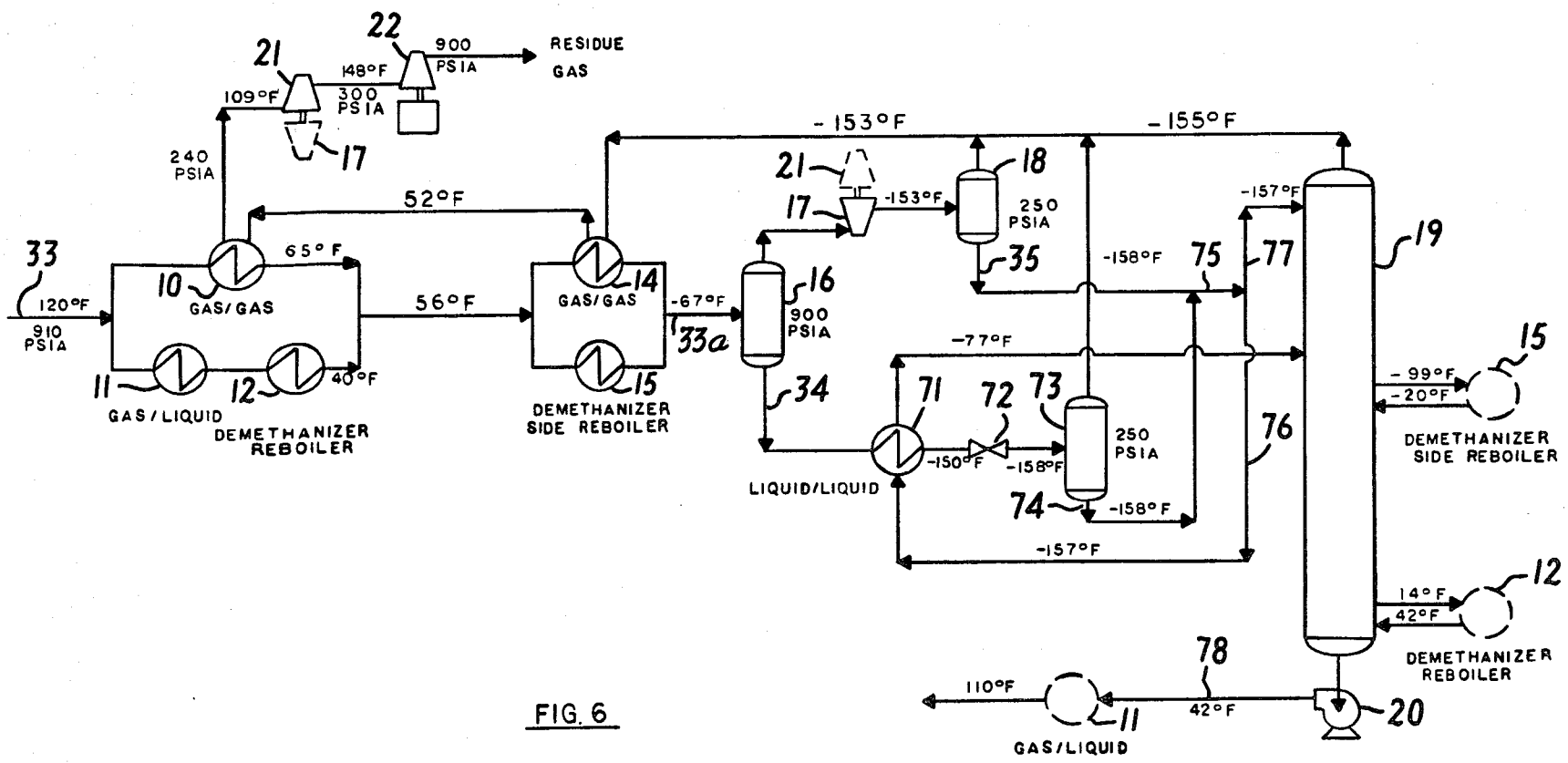
FIG. 6 is a flow diagram showing an embodiment of the present invention wherein the sub-cooled liquids and expander outlet stream enter as feeds to the top of the column.

A fourth embodiment of the process of this invention is shown in FIG. 6. As in FIG. 2, a feed gas 33 is partially condensed at −67° F. and 900 psia in heat exchangers 10, 11, 12, 14 and 15, and supplied to low pressure separator 16. The process conditions given, and the flow rates in Table VI below are for a lean feed gas. Vapors from separator 16 are work expanded in expander 17, and supplied to low pressure separator 18 at −153° F. and 250 psia, where the liquid condensed during expansion is separated, and liquid stream 35 is separated.

Liquid stream 34 from separator 16 is sub-cooled in heat exchanger 71 to −150° F., and then expanded through valve 72 to a pressure of 250 psia. A portion of the liquid vaporizes, thus cooling the remaining part to −158° F. Expanded stream enters separator 73, wherein liquid and vapor are separated. The cold liquid, stream 74, from separator 73 is combined with liquid stream 35 from separator 18 to form a combined stream 75. A first portion 76 of the combined stream is used to sub-cool condensed liquid 34 in heat exchanger 71 and is then supplied as a feed to demethanizer 19 at a mid-column location. The second part 77 of stream 75 is supplied to demethanizer 19 as the top feed at −157° F.

The data for this case are given in the following table:

TABLE VI (FIG. 6)

| Stream | Methane | Ethane | Propane | Butanes+ | Total |
|---|---|---|---|---|---|
| | Stream Flow Rate Summary - Lb. Moles/Hr. | | | | |
| 33 | 1447 | 90 | 36 | 43 | 1647 |
| 34 | 280 | 42 | 25 | 39 | 391 |
| 35 | 133 | 35 | 11 | 4 | 186 |
| 74 | 251 | 42 | 25 | 39 | 361 |
| 78 | 2 | 74 | 36 | 43 | 159 |
| Recoveries | | | | | |
| Ethane | | 81.6% | | 17,925 Gal/Day | |
| Propane | | 98.0% | | 8,924 Gal/Day | |
| Compression Horsepower | | | | | |
| Refrigeration | | | | 0 BHP | |
| Recompression | | | | 1182 BHP | |
| | | | Total | 1182 BHP | |

EXAMPLE 5

Figure 7:
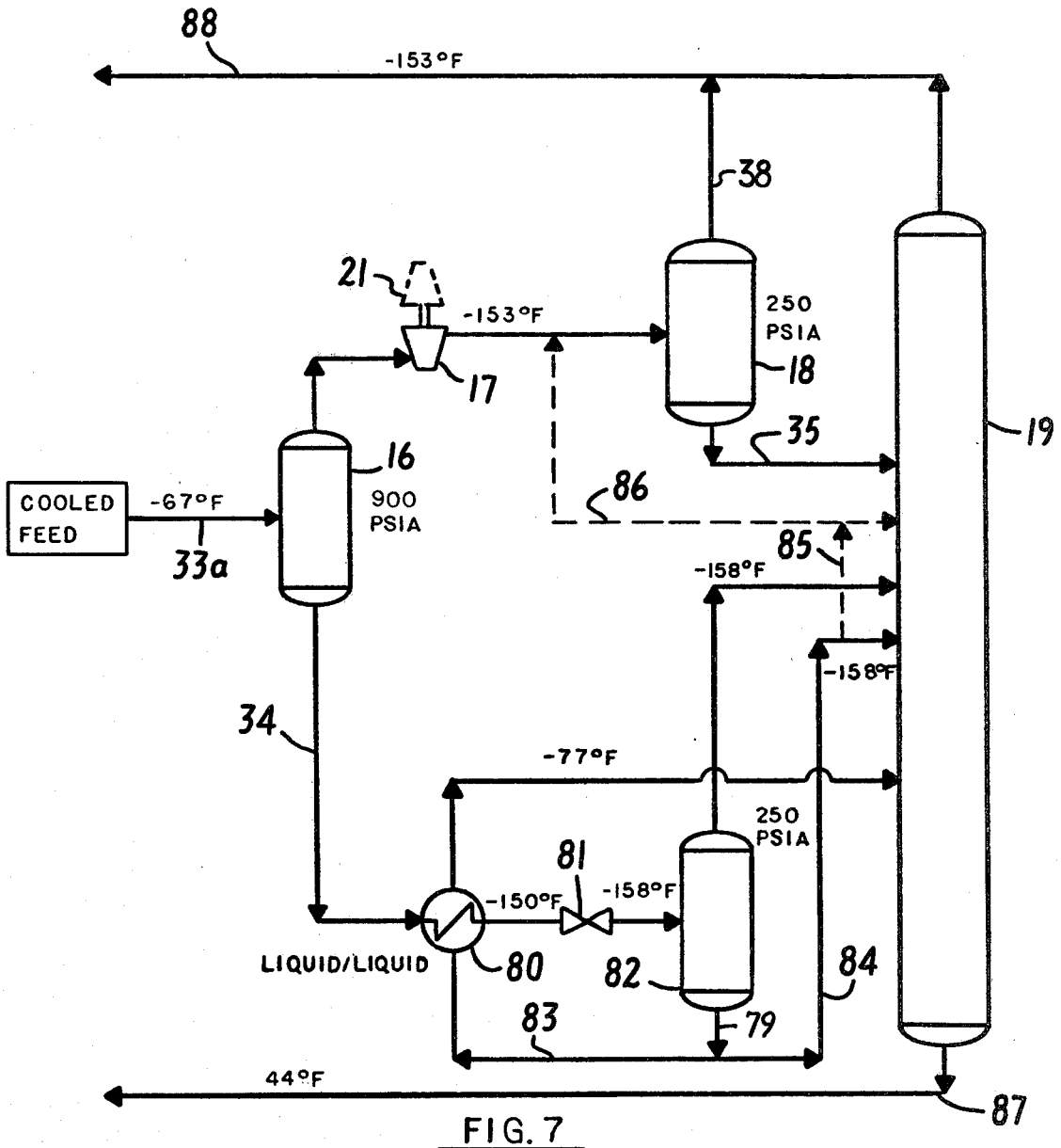
FIG. 7 is a flow diagram showing an embodiment of the present invention wherein the sub-cooled stream is fed below the expander stream inlet.

Another embodiment of the invention is shown in FIG. 7. In this case, a cooled feed stream 33a is supplied as in FIG. 5 to high pressure separator 16. Cooled stream 33a is a partially condensed lean feed gas, cooled by means of a heat exchanger chain as shown in FIG. 2.

Cold gas from separator 16 flows to expander 17 where it is expanded and provides a cold outlet stream at −153° F. to low pressure separator 18. Cold liquid outlet stream 35 from separator 18 is fed on level control to demethanizer 19 as top feed. Cold vapor from separator 18 joins vapors stripped from demethanizer 19 and flows to provide heat exchange used in cooling feed stream 33a, as in FIG. 2 and then to residue gas compression.

Condensed liquid stream 34 from high pressure separator 16 is sub-cooled in heat exchanger 80 and expanded through an expansion valve 81 to low pressure separator 82. A part of the stream vaporizes on expansion, thus cooling the remaining part to −158° F. Cold vapor from separator 82 is fed to the demethanizer 19 at an intermediate level. The cold outlet liquid stream 79 from separator 82 is divided. A first part, stream 83, is used to sub-cool stream 34 in heat exchanger 80. The second part 84 of the liquid stream from separator 82 is fed to demethanizer column 19 at an intermediate point in the column. Alternately, stream 84 may be supplied to the column at a point just below the top feed, 35, or may be mixed with the exit stream from expander 17, as shown by the broken lines 85 and 86, respectively.

Component flow rates, liquid recoveries and composition requirements are given in the following table:

TABLE VII (FIG. 7)

| Stream Flow Rate Summary - Lb. Moles/Hr. | | | | | |
|---|---|---|---|---|---|
| Stream | Methane | Ethane | Propane | Butanes+ | Total |
| 33a | 1447 | 90 | 36 | 43 | 1647 |
| 34 | 280 | 42 | 25 | 39 | 391 |
| 35 | 133 | 35 | 11 | 4 | 186 |
| 79 | 251 | 42 | 25 | 39 | 361 |
| 87 | 2 | 72 | 36 | 43 | 157 |
| 88 | 1445 | 18 | 0 | 0 | 1490 |
| Recoveries | | | | | |
| Ethane | | | 79.4% | 17,440 Gal/Day | |
| Propane | | | 98.2% | 8,935 Gal/Day | |
| Compression Horsepower | | | | | |
| Refrigeration | | | | 0 BHP | |
| Recompression | | | | 1186 BHP | |
| | | | Total | 1186 BHP | |

To summarize the foregoing discussion of the first five embodiments of our invention, the process feed is partially or completely condensed under pressure by cooling using product as well as available column side streams and (if necessary) external refrigeration. Where the feed gas under pressure is only partially condensed, the remaining vapors are expanded to provide a cooled and partially condensed expanded vapor. The liquid portion obtained by cooling and refrigeration of the feed gas under pressure is expanded (for instance by flashing, or by a work engine) whereby a portion of it vaporizes and the remaining part is cooled and used as liquid feed to a fractionator, such as a demethanizer.

Prior to expansion, the liquid portion of the feed is sub-cooled by bringing it into heat exchange relation with a portion of the expanded cold liquid. This results in two liquid feeds derived from expansion of the liquid portion of the condensed feed gas, one feed being substantially colder than the other.

Advantages of improved recovery may be realized by utilizing the divided stream in various of process configurations:

(i) By feeding both of the thus-derived liquid streams directly to the demethanizer tower, the cooler stream being used as a feed at a higher point in the column than the hotter feed. In such a configuration, the colder liquid stream may be used as all or a portion of top column feed.

(ii) By combining all or a portion of the expanded liquid stream with all or a portion of the work-expanded vapor stream to form a combined condensate, using a portion of the combined condensate to sub-cool the liquid portion of the feed gas and using the remaining condensate as column top feed.

(iii) By using the cold expanded liquid derived according to the present invention as column top feed, and feeding liquid or vapor (or both) from the expanded vapor stream at a column point below the top, whereby the cold liquid at the column top will recover absorbable ethane from the expanded vapors.

In connection with the foregoing, it should be noted that for clarity in explanation, vapor-liquid separation of the expanded liquid and vapor streams has been shown external to the demethanizer. It will be obvious to those of ordinary skill in the art that such vapor-liquid separation may equally be accomplished internally of the demethanizer column. Similarly by appropriate selection and control of side stream feeds and draw-offs, the stream obtained from flash expansion of the liquid portion of the feed gas can be fed directly to the column and internally divided to provide the desired first portion thereof utilized for sub-cooling the liquid portion of the feed gas. Where the flash expanded liquid is fed directly to the column at an intermediate column stage, liquid drawn off from that stage as the source of sub-cooling liquid will usually contain not only a portion of the liquid from the feed but also liquid flowing from the column from higher stages thereof.

It should also be noted that as illustrated in the foregoing examples, the entire condensed liquid stream from separator 16 is sub-cooled. In some cases, it may prove advantageous to treat only a portion of the liquid from separator in accordance with this invention.

In another embodiment of the present invention sub-cooling of the condensed process feed under pressure prior to expansion is accomplished by heat exchange with a liquid stream available from the demethanizer column. This is illustrated in FIG. 8 of the present invention.

EXAMPLE 6

Figure 8:
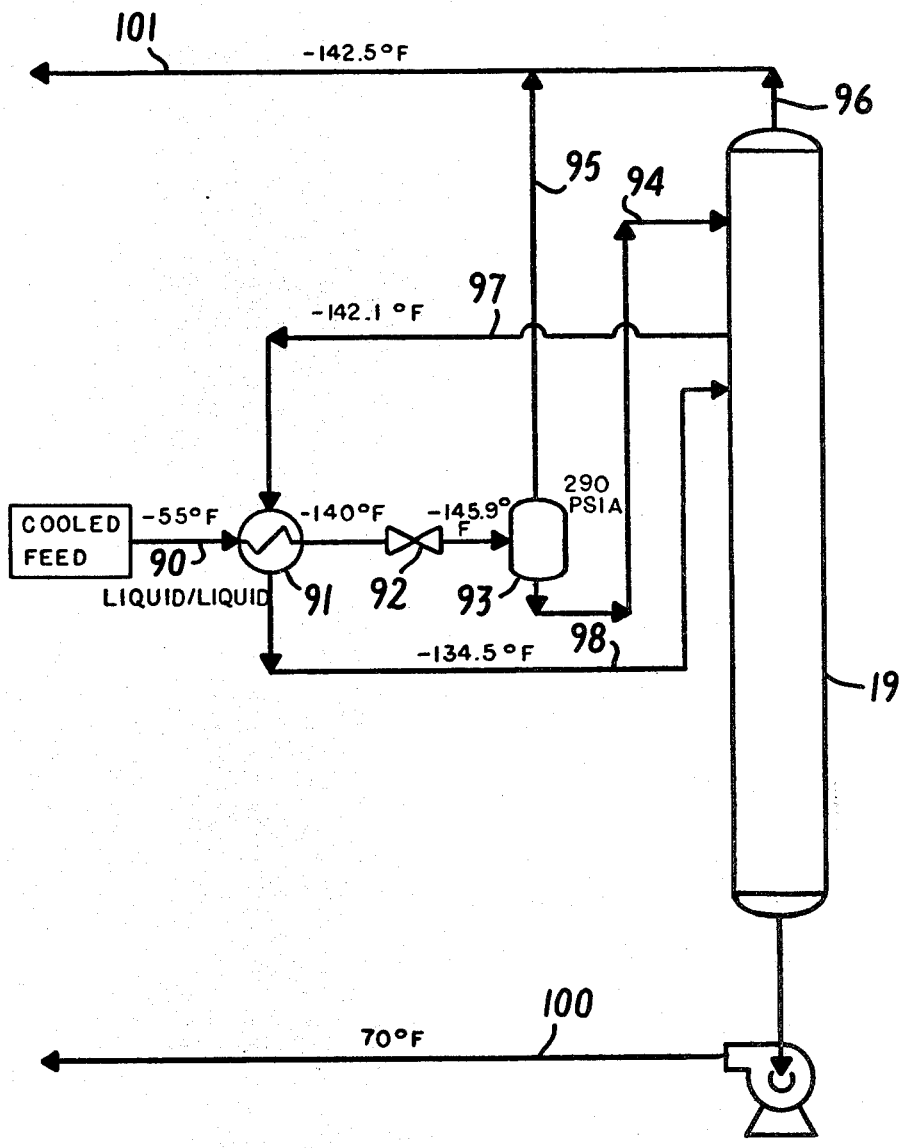
FIG. 8 is a flow diagram showing another embodiment of the present invention wherein a demethanizer side stream is used to sub-cool the liquids from the high-pressure separator.

FIG. 8 is a fragmentary process flow diagram of one aspect of this embodiment of our invention, and illustrates a specific case calculated on the assumption of total condensation of feed gas entering the process at a pressure of about 900 psia. Such a total condensation procedure is illustrated, for example, in FIG. 4 when incoming gas at a temperature of 120° F. and 910 psia is condensed by heat exchange against residue gas products, demethanizer column side reboilers, demethanizer column reboiler and demethanizer column bottoms product. For purposes of total condensation, it is usually required also to provide supplemental external refrigeration as illustrated in FIG. 4.

Referring now to FIG. 8, the totally condensed liquid feed 90, at a pressure of approximately 900 psia and a temperature of −55° F. passes through heat exchanger 91 where it is sub-cooled to a temperature of −140° F. The sub-cooled liquid is then flash expanded through expansion valve 92, and the expanded product enters separator 93. During flashing, a part of the liquid stream vaporizes and cools the remaining liquid to a temperature of about −146° F. The remaining liquid is separated in separator 93 and supplied as stream 94 to the demethanizer column 19 as top feed to the column.

Vapors flashed during the flash expansion step leaving separator 93 as vapor stream 95 are combined with overhead vapors 96 from demethanizer 19 to form a residue gas stream 101. As in FIG. 4, the residue gas stream leaving the demethanizer column is returned in heat exchange relationship with incoming feed gas to provide a portion of the cooling required to liquify the feed gas. Thereafter the residue gas is compressed to approximately 900 psia and discharged from the process.

The desired liquid product is contained in the demethanizer bottoms 100. Before this product leaves the process, it is heat exchanged with incoming feed to provide inlet gas cooling as illustrated, for example, in FIG. 4.

To provide sub-cooling of liquid stream 90 in accordance with this embodiment of the present invention, a side stream 97 is withdrawn from the demethanizer column 19 and passed through exchanger 91. The warmed side stream 98 is then returned to the demethanizer column at a point below the liquid inlet 94. For the purpose of the embodiment illustrated in FIG. 8, and in the table given below, it was assumed that demethanizer 19 contained column packing material equivalent to one theoretical distillation stage between the side stream return 98, and the top liquid feed 94.

Inlet and liquid component flow rates, outlet liquid recovery efficiencies and compression requirements for this illustration are set forth in the following table:

TABLE VIII (FIG. 8)

| Stream Flow Rate Summary - Lb. Moles/Hr. | | | | | |
|---|---|---|---|---|---|
| Stream | Methane | Ethane | Propane | Butanes+ | Total |
| 90 | 1100 | 222 | 163 | 130 | 1647 |
| 94 | 1009 | 221 | 163 | 130 | 1544 |
| 100 | 5 | 210 | 162 | 130 | 508 |
| 101 | 1095 | 12 | 1 | 0 | 1139 |
| Recoveries | | | | | |
| Ethane | | 94.5% | | 50,917 Gal/Day | |
| Propane | | 99.1% | | 40,448 Gal/Day | |
| Compression Horsepower | | | | | |
| Refrigeration | | | | 461 BHP | |
| Recompression | | | | 870 BHP | |
| | | | Total | 1331 BHP | |

It will be recognized that the use of side stream 97 to provide refrigeration to exchanger 91 will result in a side stream return 98, which is partially vaporized. The column, therefore, should provide for vapor-liquid contacting means between liquid inlet 94 and side stream return 98 so that the warmed vapors rising from side stream return 98 will be cooled before appearing in column overhead vapors 96.

The fractionation means promotes vapor-liquid contact in this column region to facilitate heat exchange between the rising vapors and descending liquid. It will be evident to those skilled in the art that the amount of vapor-liquid contact thus provided may vary and may be provided by one or more bubble plates, sieve trays, etc., or by a greater or lesser amount of packing material.

In preferred embodiments of this invention, the demethanizer column 19 should provide for sufficient exchange between liquid inlet 94 and side stream return 98 that the vapors rising past the liquid inlet point 94 will have a temperature which did not exceed by more than about 10° F., the temperature of the incoming liquid 94.

While the present invention has been described with particular reference to an embodiment in which the side stream withdrawal 97 and return 98 occur at the same point of the demethanizer 19, it is not necessary that the side stream return 98 correspond to the side stream withdrawal point 97. It may, for example, be advantageous from the standpoint of column efficiency and heat balance to return side stream 98 at a point below where side stream 97 is withdrawn.

For purposes of illustration, it will also be recognized that while the heat exchanger 91 has been illustrated as a heat exchanger external to the demethanizer column supplied by side stream withdrawal 97, a fully equivalent result may be obtained by providing for an internal heat exchanger within demethanizer 19 in lieu of the external heat exchanger 91. In such a case, the internal heat exchanger would be located so as to correspond to the side stream return point 98.

It will also be evident from illustrations to other embodiments of the present invention, such as in FIGS. 3, 5, 6 and 7, that the feed stream 90 need not be chilled to the point of total condensation, nor is it necessary to sub-cool the entire liquid stream 90. If the feed stream 90 is partially condensed, as for example in FIG. 3, provision will be made for separation of the partially condensed process feed. The liquid recovered from partial condensation of the feed will be further treated as illustrated in FIG. 8. The vapor recovered may be work expanded, such as by a turbo-expander to produce an expanded and partially condensed vapor stream, the partial condensate that is recovered being supplied to the demethanizer column. As is apparent from FIGS. 5, 6 and 7, further variations are possible. For example, if the initial feed is only partially condensed, and a work-expanded vapor is therefore available, all or a part of work-expanded vapor stream may, if desired, be supplied to the demethanizer column as an intermediate feed, and the sub-cooled liquid 94 used as a demethanizer top feed as illustrated in FIG. 8.

Still another embodiment of the present invention has particular reference to gas separation processes in which the feed gas under pressure is partially condensed to produce a liquid portion and a vapor portion. The liquid portion is sub-cooled and expanded to a lower pressure to produce thereby a cold liquid feed supplied to the fractionation column. The vapor portion is expanded to the lower pressure resulting in cooling and partial condensation of the vapor portion. The refrigeration produced by the expansion of the vapor portion is employed to sub-cool the liquified portion of the feed gas under pressure prior to expansion.

Figure 9:
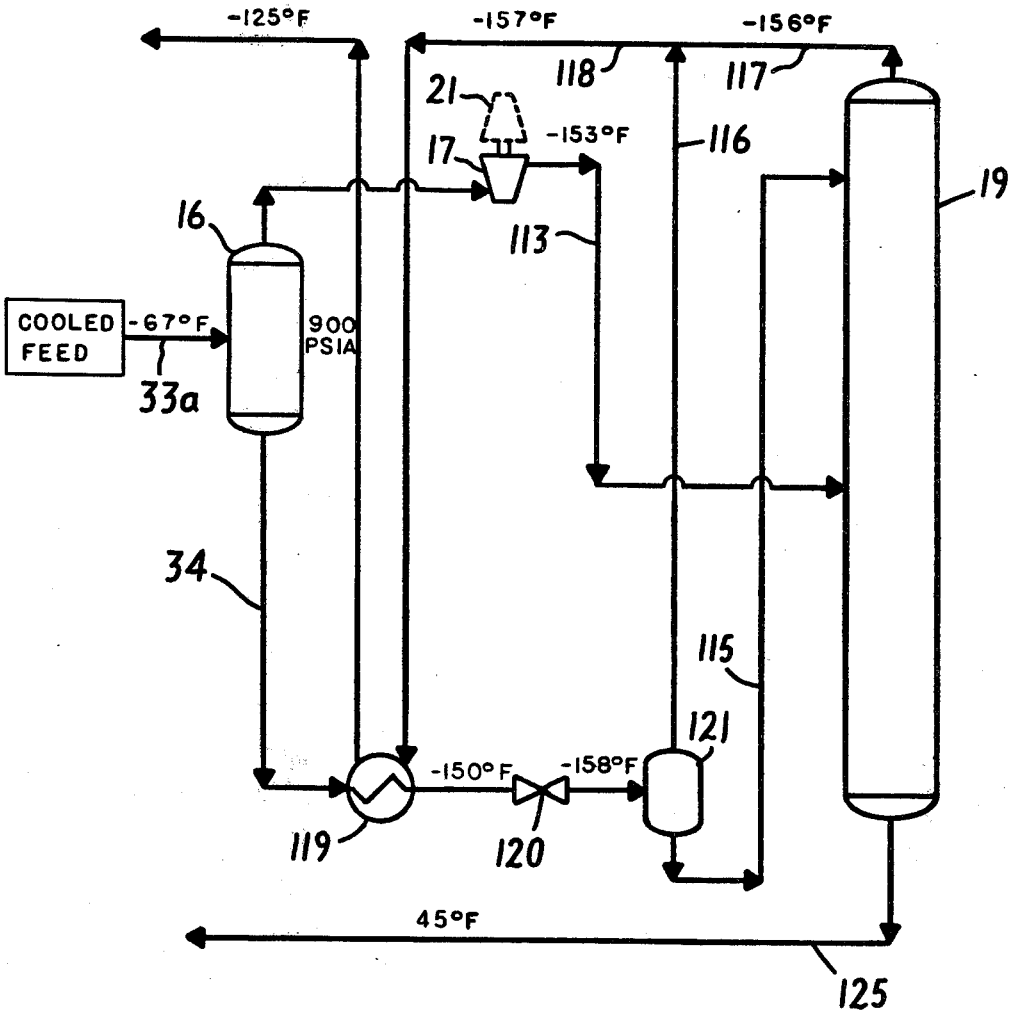
FIG. 9 is a flow diagram showing still another embodiment of the present invention wherein the liquids from the high-pressure separator are sub-cooled by heat exchange with vapor product stream.
Figure 10:
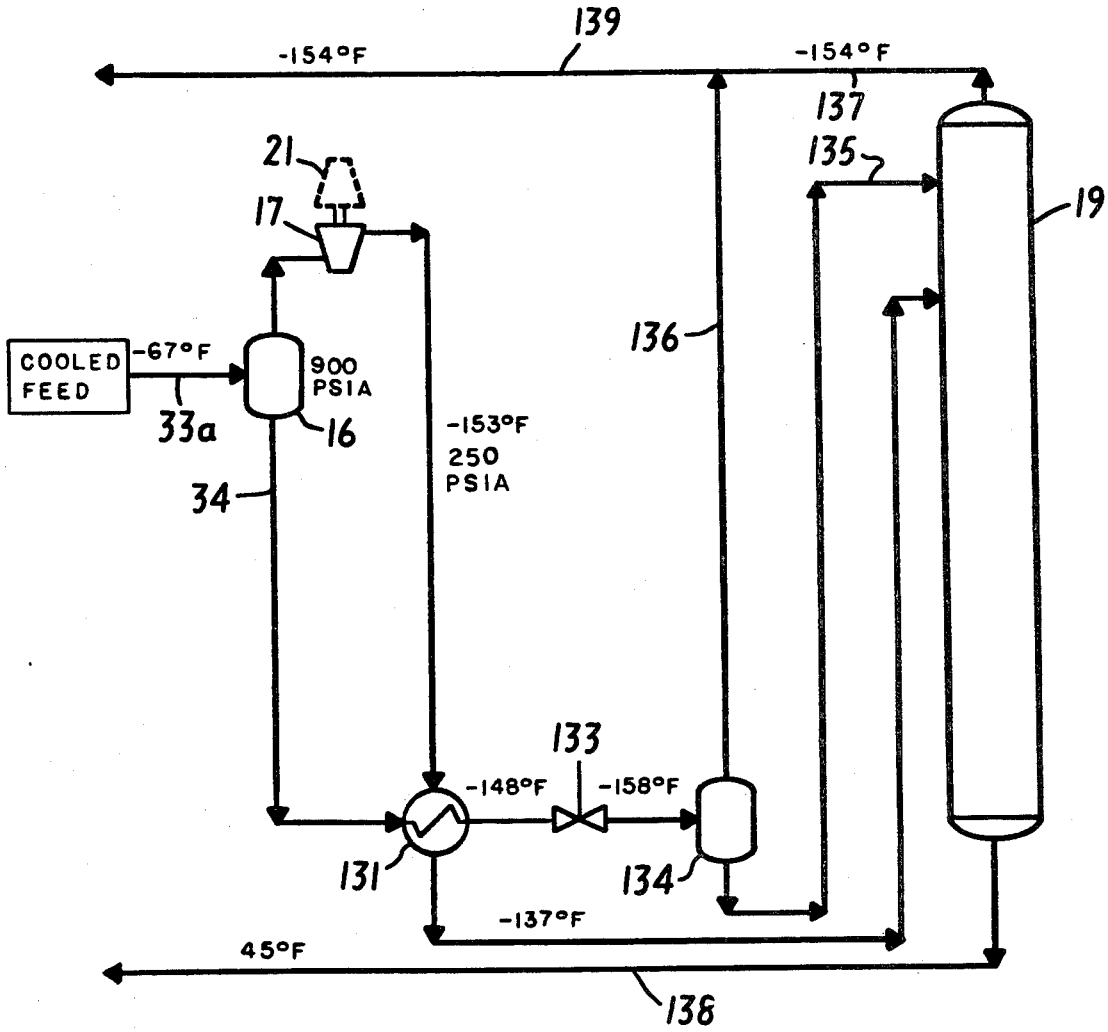
FIG. 10 is a flow diagram showing an embodiment of the present invention wherein the expander outlet is used to sub-cool the liquids from the high-pressure separator.

This embodiment is more specifically illustrated in FIGS. 9 and 10. Both FIGS. 9 and 10 represent only partial flow diagram of an overall gas separation plant. As indicated on both drawings, the fragmentary portion illustrated is supplied with cooled feed gas. Such cooled feed gas is derived in a conventional manner as shown by the heat exchange system FIGS. 1 and 2 involving heat exchangers 10, 11, 12, 13, 14 and 15. These heat exchangers recover refrigeration values contained in the product and residue gas of the gas separation plant and incorporate additional external refrigeration to the extent necessary to cool the feed gas under pressure to a condition entering the fragmentary portion of the separation process illustrated.

The process conditions described in FIGS. 9 and 10 correspond to the processing of a lean feed gas of the composition set forth above in Table II. The process conditions in FIGS. 9 and 10 may be compared with FIG. 2 to illustrate the present invention. At the inlet conditions in each of FIGS. 9 and 10, the cooled lean feed gas 33*a* is at a temperature of −67° F. and a pressure of 900 psia.

EXAMPLE 7

Following is the process of FIG. 9, the partially condensed feed gas 33*a* derived as described in FIG. 2, comprises partially condensed gases containing a liquid portion and a vapor portion. The partially condensed gas enters a high pressure separator 16 where liquid and vapors are separated. Following first the vapors leaving separator 16, the vapors enter a work expansion engine 17 in which mechanical energy is extracted from the vapor portion of the high pressure feed. As that vapor is expanded from a pressure of about 900 psia to a pressure of about 250 psia, the work expansion cools the expanded vapor 113 to a temperature of approximately −153° F. Expanded and partially condensed vapor 113 is supplied as a feed to demethanizer 19, wherein the vapors rise and a major part of $C_2$+ hydrocarbons are absorbed by descending liquid. Demethanizer overhead 117 at a temperature of −156° F. combined with vapors 116 from flash vaporization described below to form residue gas stream 118. The combined cold residue gas stream 118 then passes through heat exchanger 119. The warmed residue gas at −125° F. leaving heat exchanger 119 then returns to the preliminary cooling stages as illustrated, for example, in FIG. 2, wherein further refrigeration contained in the still cold residue gas is recovered, and the residue gas is compressed in compressor 21 (see FIG. 2) which is driven by work expansion engine 17, and then further compressed to a line pressure of 900 psia by supplementary compressor 22.

Turning to the liquid 34 recovered from separator 16, liquid 34 passes through heat exchanger 119 in heat exchange relation with the cold residue gas 118. This results in a pre-cooling of the liquid portion of the partially condensed high pressure feed gas. The sub-cooled liquid is then expanded through an appropriate expansion device, such as expansion valve 120, to a pressure of approximately 250 psia. During expansion a portion of the feed will vaporize, resulting in cooling of the remaining liquid part. In the process as illustrated in FIG. 9, the expanded stream leaving expansion valve 120 reaches a temperature of −158° F. and enters a separator 121. The liquid portion is separated and supplied as stream 115 to the fractionation column 19 as top feed.

It may be noted that by comparison with FIG. 2, the demethanizer feed from expansion valve 30 of FIG. 2 only achieves a temperature of −134° F. Because stream 115 of this embodiment to the present invention is substantially cooler, it may be used as top feed to the demethanizer to recover ethane in the stream 113. The ethane recovered is withdrawn in the demethanizer bottoms 125. Demethanizer bottoms 125 are heat exchanged with incoming feed to recover refrigeration therein as generally illustrated in FIGS. 1 and 2.

In connection with FIG. 9, it should be noted that for purposes of heat economy there will be one or more demethanizer side-stream reboilers which exchange heat to cool incoming feed (not shown in FIG. 9) as illustrated generally in FIG. 2. For purposes of the illustrated process, calculations appearing in FIG. 9 and set forth in the table below, two such side-stream reboilers have been included, as shown in FIG. 2. The side-stream reboilers are significant to the overall heat economy of the process. Sub-cooling of the liquid stream 34 by residue gas 118 reduces the available refrigeration remaining in stream 118 for feed cooling purposes. However, the increased loading of demethanizer 19 with liquid stream 115 cooled in accordance with the present invention provides additional available refrigeration in the side-stream reboilers. Accordingly the overall heat balance of the process remains substantially unaffected.

Inlet and liquid component flow rates, outlet recovery efficiencies, and expansion/compression requirements for the embodiment of this invention as illustrated in FIG. 9 are set forth in the following table:

TABLE IX (FIG. 9)

Stream Flow Rate Summary - Lb. Moles/Hr.

| Stream | Methane | Ethane | Propane | Butanes+ | Total |
|---|---|---|---|---|---|
| 33a | 1447 | 90 | 36 | 43 | 1647 |
| 34 | 280 | 42 | 25 | 39 | 391 |
| 113 | 1167 | 48 | 11 | 4 | 1256 |
| 115 | 251 | 42 | 25 | 39 | 361 |
| 116 | 29 | 0 | 0 | 0 | 30 |
| 118 | 1445 | 10 | 1 | 0 | 1483 |
| 125 | 2 | 80 | 35 | 43 | 164 |

| Recoveries | | |
|---|---|---|
| Ethane | 89.1% | 19,565 Gal/Day |
| Propane | 97.7% | 8,894 Gal/Day |

| Compression Horsepower | |
|---|---|
| Refrigeration | 0 BHP |
| Recompression | 1177 BHP |
| Total | 1177 BHP |

The stream flow rate summary set forth in Table IX corresponds to processing a lean feed gas. For comparison purposes, reference may be made to FIG. 2 and Table II for the processing of the same feed gas stream without the provision of pre-cooling of condensed high pressure feed gas liquids such as in heat exchanger 119.

The materially improved recoveries of the present invention result primarily because of the availability of a substantially colder liquid feed obtained by sub-cooling and expansion of the liquid condensed from the high pressure feed gas. By the present invention, this expanded liquid is available at a temperature sufficiently cold to permit its use as the top feed to demethanizer 19. Because of the significant propane and $C_4$+ content of this very cold liquid stream, it has enhanced capability for recovering ethane.

In the foregoing example, sub-cooling of liquid stream 34 with residue gas has been illustrated using combined residue gas streams. Other residue gas streams may equally well be used if they are sufficient volume relative to stream 34, such as either of stream 116 or 117 shown in FIG. 8, residue gas stream 47 shown in FIG. 3, or the residue gas stream 38 shown in FIG. 7. As used herein, in any of the claims of this application, the term "residue gas" is intended to encompass any one of the streams or any combination thereof.

EXAMPLE 8

Another illustration of this embodiment of the present invention is set forth in FIG. 10. Following the process of FIG. 10, cooled and partially condensed feed gas 33a enters high pressure separator 16 at a temperature of −67° F. and 900 psia wherein it is separated into a liquid portion and a vapor portion. As described, for example, in FIG. 2, this cooled feed gas is obtained by heat exchange preferably with various process streams to recover the maximum refrigeration values contained therein, with a provision for addition of supplemental external refrigeration, if required.

Referring first to the vapors recovered from separator 16, these vapors are work expanded through turbo-expander 17 to a pressure of about 250 psia, and a temperature of −153° F. At these conditions the expanded vapor portion of the high pressure feed is partially condensed. The entire expanded and partially condensed vapors, leaving turbo-expander 17, then pass through heat exchanger 131, wherein they are heated to a temperature of about −137° F. and supplied to the demethanizer 19 at a mid-point of the column.

Returning to the liquids leaving separator 16, liquid stream 34 passes through heat exchanger 131 in a heat exchange relation with expanded vapor stream from turbo-expander 17. This results in pre-cooling the liquid 34 from the separator 16 from a temperature of −67° F. to a temperature of −148° F. Thereafter, the sub-cooled liquid 34 is expanded through expansion valve 133 to a temperature of −158° F. and enters separator 134.

In separator 134 vapor evolved as a consequence of flash expansion is separated from the remaining liquid. The remaining liquid 135 from the expansion step is supplied to demethanizer 19 as top feed. Vapor 136 from separator 134 is taken in combination with demethanizer overhead 137 to form a combined vapor stream 139 which exits the process. As illustrated in FIG. 2, the overhead vapors exiting the process are used to cool and partially condense incoming feed gas and are then compressed in compressor 21 driven by turbo-expander 17 and in supplemental compressor 22 to a line pressure of 900 psia.

Bottom 138 from demethanizer 19 containing the desired liquid product is also employed to cool incoming feed gas and exits the process as a desired product.

Although not specifically illustrated in FIG. 10, it should be noted that as is customary in demethanizer design, side-stream reboilers may be provided as illustrated, for example, in FIG. 2 to control demethanizer operation and at the same time recover additional refrigeration values useful for pre-cooling the high pressure gas feed. The process conditions and stream summary calculations set forth in FIG. 10 and in Table X below are based on the use of two reboilers as shown in FIG. 2.

Inlet and liquid component flow rates, outlet liquid recovery efficiencies and expansion/compression requirements for a process as illustrated in FIG. 10, which included demethanizer side reboilers are given in the following table:

TABLE X

Stream Flow Rates Summary - Lb. Moles/Hr.

TABLE X-continued

| Stream | Methane | Ethane | Propane | Butanes+ | Total |
|---|---|---|---|---|---|
| 33a | 1447 | 90 | 36 | 43 | 1647 |
| 34 | 280 | 42 | 25 | 39 | 391 |
| 135 | 251 | 42 | 25 | 39 | 361 |
| 136 | 29 | 0 | 0 | 0 | 30 |
| 138 | 2 | 79 | 35 | 43 | 161 |
| 139 | 1445 | 11 | 1 | 0 | 1486 |
| Recoveries | | | | | |
| Ethane | | 87.3% | | 19,159 Gal/Day | |
| Propane | | 97.6% | | 8,880 Gal/Day | |
| Compression Horsepower | | | | | |
| Refrigeration | | | | 0 BHP | |
| Recompression | | | | 1180 BHP | |
| | | | Total | 1180 BHP | |

The embodiment illustrated in FIG. 10 provides materially improved recovery of ethane values contained in the feed gas because of the availability of a cold top feed to demethanizer 19, stream 135, provided by pre-cooling stream 34 prior to flash expansion in accordance with the present invention for use as column overhead liquid. In this embodiment it will be noted that the entire liquid and vapor stream leaving expander 17 enters the demethanizer 19 below the liquid feed 135. The cold liquid feed 135 containing substantial amounts of propane and butane and higher hydrocarbons is capable of absorbing increased amounts of desirable products contained in the vapors leaving vapor liquid separator 16.

EXAMPLE 9

Figure 11:
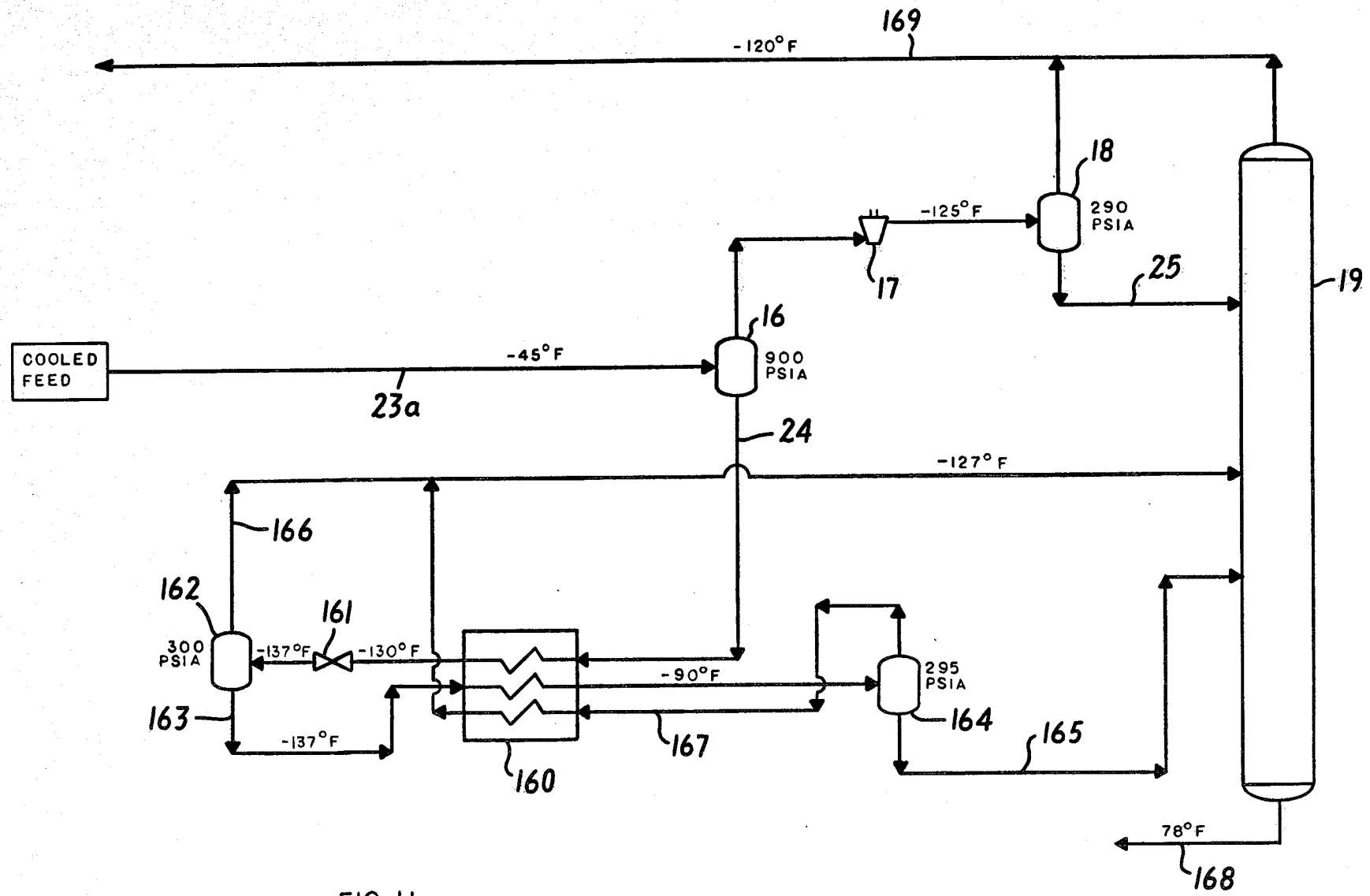
FIG. 11 is a flow diagram showing another embodiment of the invention.

FIG. 11 shows another embodiment of this invention. Plant inlet gas, from which $CO_2$, sulfur-containing gases and moisture has been substantially removed, is cooled by heat exchange with product streams as shown in FIG. 1, and supplied to separator as a cooled, partially condensed feed 23 at 900 psia and −45° F. As in FIG. 1, process conditions given, and flow rates in Table XI below are for a rich feed gas. Cooled gas from separator 16 flows through expander 17, and the outlet stream thereof, at −125° F. and flows to separator 18. Condensed liquid collected in separator 18 is fed as stream 25 to demethanizer column 19 as top feed. Vapors from separator 18 join the column overhead vapors from demethanizer 19, to form stream 169 which, after heat exchange and recompression, becomes residue gas.

Condensed liquid from high pressure separator 16 is fed as stream 24 at −45° F. to heat exchanger 160 where it is sub-cooled to −130° F. The cooled liquid is then fed through an expansion valve 161 whereby it is further cooled to −137° F. and fed to low pressure separator 162 at 300 psia. Condensed liquid from separator 162 flows as stream 163 through heat exchanger 160 in heat exchange relation with stream 24 and stream 167 where it is warmed to −90° F. and fed to separator 164. Condensed liquid from separator 164 is fed to demethanizer column 19 as stream 165. The vapor from separator 164 is returned through exchanger 160 as stream 167 where it is cooled to −125° F. in exchange with stream 163 and then mixed with vapor stream 166 from separator 162. The combined vapors at −127° F. are fed to the demethanizer column 19 at an intermediate point. Ethane and higher hydrocarbon liquids are collected as bottoms from demethanizer 19 as stream 168.

Component flow rates, liquid recoveries, and compression requirements for this embodiment are given in the following table:

TABLE XI (FIG. 11)

| Stream | Methane | Ethane | Propane | Butanes+ | Total |
|---|---|---|---|---|---|
| | Stream Flow Rate Summary - Lb. Moles/Hr. | | | | |
| 23a | 1100 | 222 | 163 | 130 | 1647 |
| 24 | 795 | 202 | 157 | 129 | 1300 |
| 25 | 16 | 10 | 5 | 1 | 32 |
| 163 | 711 | 201 | 157 | 129 | 1209 |
| 165 | 184 | 169 | 153 | 128 | 636 |
| 168 | 4 | 175 | 160 | 130 | 470 |
| 169 | 1097 | 47 | 3 | 0 | 1177 |
| Recoveries | | | | | |
| Ethane | | 78.9% | | 42,511 Gal/Day | |
| Propane | | 98.2% | | 40,090 Gal/Day | |
| Compression Horsepower | | | | | |
| Refrigeration | | | | 440 BHP | |
| Recompression | | | | 815 BHP | |
| | | | Total | 1255 BHP | |

EXAMPLE 10

In still another example of the present invention, it may be advantageous to provide two separate expansion valves for expansion of the sub-cooled high-pressure liquid condensate. This modification may be better understood by reference to FIG. 12, which may be compared with FIG. 5. Referring first to FIG. 5, it will be noted that the high-pressure liquid condensate from separator 16 (stream 34) is sub-cooled in heat exchanger 61, expanded in expansion valve 65 and separated into a liquid and vapor stream in separator 64.

In accordance with the modification of the present invention in this Example 10, liquid stream 34 is sub-cooled in exchanger 150. The sub-cooled liquids from exchanger 150 are divided prior to expansion into two portions (streams 170 and 171). Stream 170 expands through expansion valve 172 and achieves an expanded temperature of −158° F. The expansion products are used to sub-cool liquid stream 34 in heat exchanger 150 and then supplied to the demethanizer 19 as feed stream **170*a*. Portion 171 of the sub-cooled high-pressure liquid is expanded in expansion valve 173, again reaching an expansion temperature of −158° F. and supplied to the demethanizer 19 as top feed 171*a***.

Both feed streams **170*a* and 171*a* are vapor-liquid mixtures and, accordingly, the demethanizer column will be provided at the feed points with appropriate column internals (such as chimney trays or the like) which will effect vapor-liquid separation of the feeds. In the embodiment illustrated in the present example, there will normally also be one or more distillation trays, sieve trays, or an appropriate column packing between the feed points of streams 170*a* and 171*a* to provide for vapor-liquid contact between the liquids falling through the column from feed 171*a* and vapors rising through the column from feed stream 170*a***.

Figure 12:
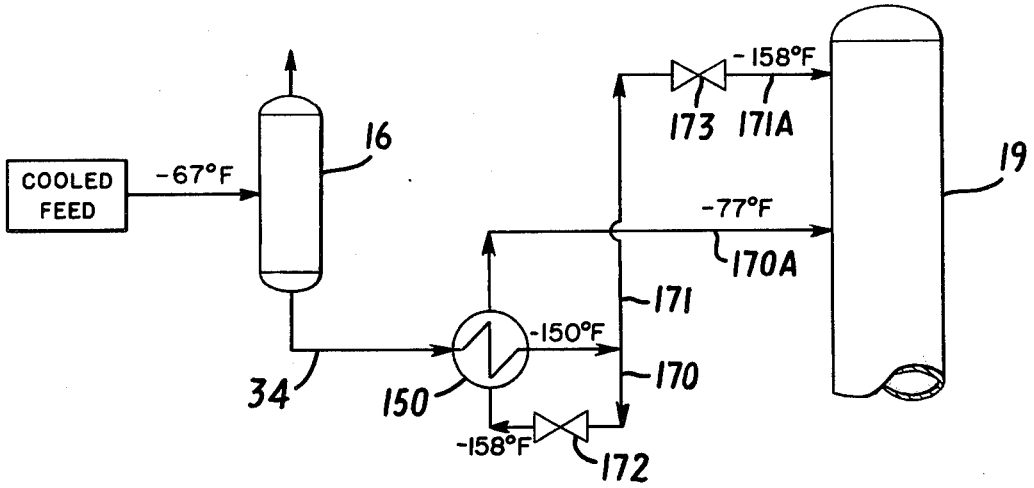
FIGS. 12 and 13 represent further embodiments of the present invention wherein two parallel expansion steps are employed.

It will be recognized that FIG. 12 is a fragmentary flow diagram illustrating only the treatment of high-pressure liquid stream 34 from separator 16. As will be apparent from a comparison with FIG. 5, appropriate provisions also will be made for expansion of the vapors leaving separator 16 and supplying those vapors to the demethanizer as an appropriate feed stream. Provisions also will be made for cooling and partial condensation of high-pressure feed gas initially entering the process at a pressure of 910 psia and a temperature of 120° F. by heat exchange with residue gas demethanizer side reboilers and demethanizer bottoms liquid (none of these heat exchangers being shown in fragmentary FIG. 12).

Provision for two expansion devices as 172 and 173 of this example and feeding the expanded products directly to the demethanizer column 19 provides improved mechanical simplicity since it eliminates the need for vapor-liquid separators if the separation is done external to the column and eliminates piping for side stream withdrawal and return as in Example 6 (FIG. 8). The performance of this modification can be seen from the following process flow stream summary (the flow stream conditions being comparable to FIG. 5):

TABLE XII (FIG. 12)

| Stream | Methane | Ethane | Propane | Butanes+ | Total |
|---|---|---|---|---|---|
| | Stream Flow Rate Summary - Lb. Moles/Hr. | | | | |
| 34 | 280 | 43 | 25 | 39 | 391 |
| 170 | 140 | 21 | 12 | 19 | 195 |
| 171 | 140 | 21 | 13 | 20 | 196 |

The component recovery of $C_2+$ fraction for this illustration should be increased relative to the component recoveries of FIG. 2 above, and the horsepower requirements should be reduced.

EXAMPLE 11

Figure 13:
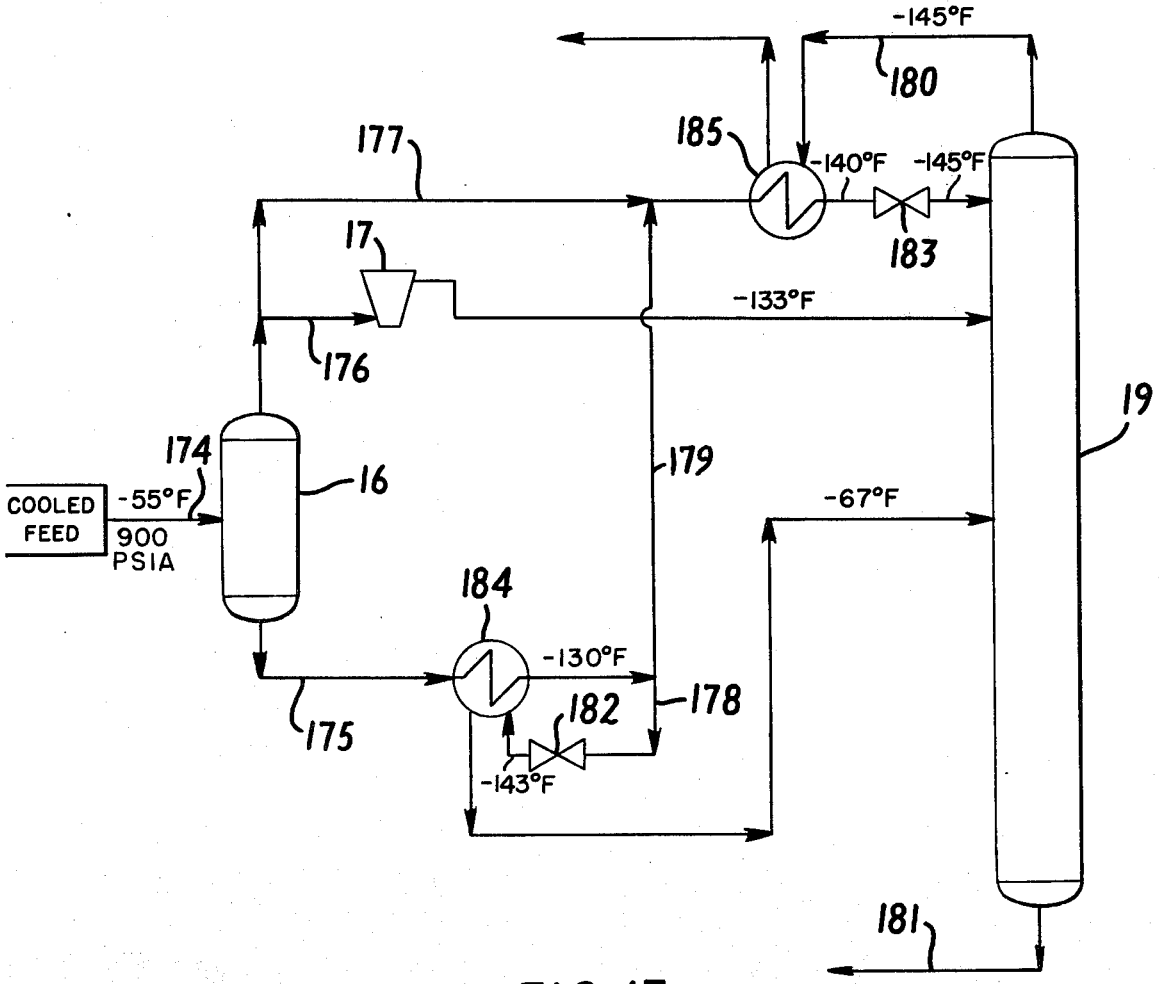

The following is another example of the use of two separate expansion valves for the expansion of the sub-cooled liquid condensate and may be understood by reference to FIG. 13.

FIG. 13 is a fragmentary flow process diagram for the separation of cooled and partially condensed high-pressure gas 174 supplied to separator 16 at a temperature of −55° F. and a pressure of 900 psia. Prior art processes similar to those shown in FIGS. 1 and 2 are used to cool the inlet gas to −55° F. These include provision for heat exchange with residue gas, external refrigeration (if needed), demethanizer bottoms and one or more demethanizer side reboilers as illustrated in FIGS. 1 and 2 but not shown in the fragmentary drawing FIG. 13.

The process flow conditions indicated in FIG. 13 differ from those set forth in FIGS. 1 and 2 since the assumed composition employed for purposes of inlet feed gas 174 of FIG. 13 was intermediate in composition between the rich and lean gases on which FIGS. 1 and 2 are based. For purposes of the calculations, two demethanizer side boilers (not shown) were assumed, as in FIGS. 1 and 2.

Referring to FIG. 13, the cooled vapor from separator 16 is divided into two portions. The first portion 176 flows through expander 17 where, because of work expansion from 900 to 290 psia, it is cooled to about −133° F. From expander 17 the chilled vapor flows to demethanizer 19 as its middle feed. The second vapor portion 177 is combined with a portion 179 of the sub-cooled liquid from heat exchanger 184 as explained below.

The cooled liquid 175 from separator 16 flows through exchanger 184 where it is sub-cooled to −130° F. by heat exchange with the cold stream from expansion valve 182. The sub-cooled liquid is then divided into two portions. The first portion 178 flows through expansion valve 182 where it undergoes expansion and flash vaporization as the pressure is reduced from about 900 to 250 psia. The cold stream from expansion valve 182 then flows through exchanger 184 where it is used to sub-cool the liquids from separator 16. From exchanger 184, the stream flows to demethanizer 19 as its lowest feed.

The second liquid portion 179 from exchanger 184, still at high pressure, is combined with portion 177 of the vapor stream from separator 16. The combined stream then flows through heat exchanger 185 where it is sub-cooled to approximately −140° F. by heat exchange with cold vapor stream 180. The sub-cooled stream then enters expansion valve 183 where it undergoes expansion and flash vaporization as the pressure is reduced from 895 psia to 250 psia. From expansion valve 183, the cold stream proceeds to demethanizer 19 as its top feed.

Inlet and liquid component flow rates, outlet recovery efficiencies, and expansion/compression requirements for the embodiment of this invention as illustrated in FIG. 13 are given in the following table:

TABLE XIII (FIG. 13)

| Stream Flow Rate Summary - Lb. Moles/Hr. | | | | | |
|---|---|---|---|---|---|
| Stream | Methane | Ethane | Propane | Butanes+ | Total |
| 174 | 1304 | 162 | 80 | 54 | 1647 |
| 175 | 486 | 109 | 66 | 51 | 723 |
| 176 | 723 | 47 | 12 | 2 | 817 |
| 177 | 95 | 6 | 2 | 1 | 107 |
| 178 | 243 | 54 | 33 | 26 | 361 |
| 179 | 243 | 55 | 33 | 25 | 362 |
| 180 | 1301 | 14 | 1 | 0 | 1362 |
| 181 | 3 | 148 | 79 | 54 | 285 |

| Recoveries | | |
|---|---|---|
| Ethane | 91.47% | 36,036 Gal/Day |
| Propane | 98.38% | 19,732 Gal/Day |

| Horsepower Requirements | |
|---|---|
| Refrigeration | 130 BHP |
| Recompression | 987 BHP |
| Total | 1117 BHP |

EXAMPLE 12

Figure 14:
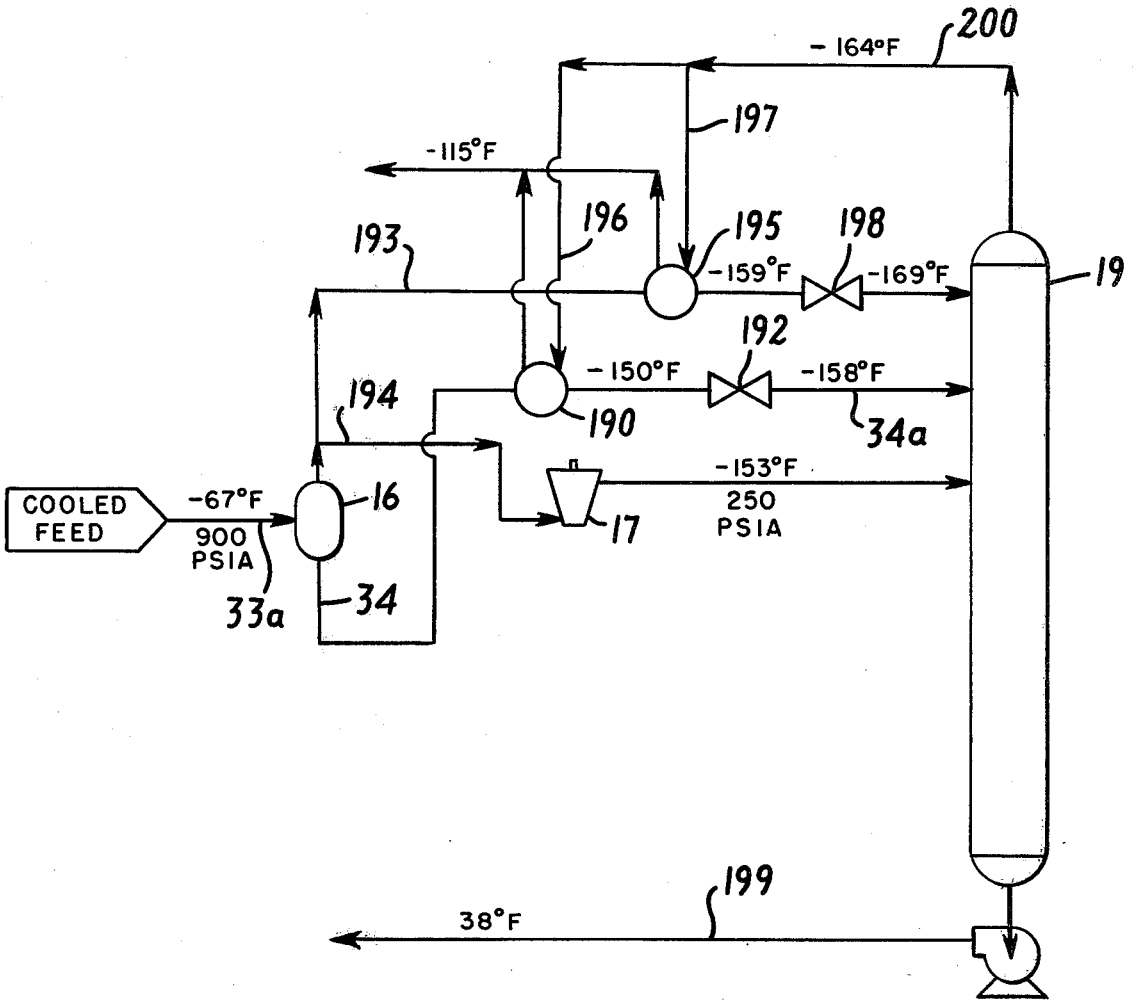
FIG. 14 is an embodiment of the present invention wherein a portion of the uncondensed high pressure vapor stream is condensed by column overhead vapor.

Another embodiment of the present invention is illustrated by FIG. 14. FIG. 14 is a fragmentary flow diagram showing the treatment of a partially-condensed feed gas 33*a* entering high pressure separator 16 at −67° F. and 900 psia. The feed gas is partially condensed by heat exchange with residue gas, ethane product and demethanizer liquids as shown in FIG. 2. As in FIG. 2, the process conditions set forth, as the flow rates in Table 14 below, are for a lean feed gas.

Following the process of FIG. 14, the liquid stream 34 from separator 16 is sub-cooled through heat exchanger 190 in heat exchange relation with a portion 196 of the overhead vapor stream 200 from the demethanizer 19 resulting in sub-cooling of the liquid stream 34. The sub-cooled stream is then expanded through an appropriate expansion device, such as expansion valve 192, to a pressure of approximately 250 psia. During expansion a portion of the feed will vaporize, resulting in cooling of the remaining part. In the process illustrated in FIG. 14, the expanded liquids leaving expansion valve 192 reach a temperature of about −158° F., and are supplied to the demethanizer column 19 as an intermediate feed 34*a*.

The vapor from separator 16 is split into streams 193 and 194 as it leaves the top of the separator. The first portion, stream 193, flows through exchanger 195 where it is chilled to about −159° F. by heat exchange with another portion 197 of demethanizer overhead vapors 200. From exchanger 195 the chilled vapor portion flows through expansion valve 198, where it undergoes expansion and flash vaporization as the pressure is reduced to about 250 psia. The flash expansion further cools the stream to about −169° F. From expansion valve 198 the stream flows to demethanizer 19 as top feed to the column.

The second portion, 194, of vapor from separator 16 enters a work expansion engine 17 in which mechanical energy is extracted from this portion of the high pressure feed. As that vapor is expanded from a pressure of about 900 psia to a pressure of about 250 psia, the work expansion cools the expanded vapor in stream 194 to a temperature of approximately −153° F. The expanded and partially condensed vapor is supplied as feed to demethanizer 19 at an intermediate point on the column, below the sub-cooled liquid stream feed 34*a*.

It may be noted that by comparison with FIG. 3 the stream leaving expander 17 and entering the demethanizer column achieves a temperature of about −153° F. As a result of splitting the vapor stream from separator 16, and cooling one of the streams prior to expansion, a colder demethanizer top feed can be realized.

The stream flow rates, component recoveries, and expansion/compression requirement for the process illustrated in FIG. 14 are given in the following table:

TABLE XIV (FIG. 14)

| Stream Flow Rate Summary - Lb. Moles/Hr. | | | | | |
|---|---|---|---|---|---|
| Stream | Methane | Ethane | Propane | Butanes+ | Total |
| 33a | 1447 | 90 | 36 | 43 | 1647 |
| 34 | 280 | 42 | 25 | 39 | 391 |
| 193 | 102 | 4 | 1 | 0 | 110 |
| 194 | 1065 | 44 | 10 | 4 | 1146 |
| 196 | 956 | 4 | 0 | 0 | 976 |
| 197 | 489 | 2 | 0 | 0 | 500 |
| 199 | 2 | 84 | 36 | 43 | 171 |
| 200 | 1445 | 6 | 0 | 0 | 1476 |

| Recoveries | | |
|---|---|---|
| Ethane | 92.8% | 20,377 Gal/Day |
| Propane | 99.5% | 9,057 Gal/Day |

| Horsepower Requirements | |
|---|---|
| Refrigeration | 0 BHP |
| Recompression | 1224 BHP |
| Total | 1224 BHP |

In light of the foregoing disclosures, still other variations of the process of the present invention will be evident:

1. As already noted it may, in appropriate cases, be desirable to sub-cool only a portion of the high-pressure condensed liquid feed prior to expansion.

2. As explained in the co-pending application of Campbell and Wilkinson, Ser. No. 712,771, now abandoned, filed concurrently herewith, it may be desirable to combine the sub-cooled, high-pressure liquid feed (either before or after sub-cooling) with a process stream containing substantial quantities of volatile fractions capable of reducing the bubble point of the high-pressure sub-cooled liquid feed (for example, as illustrated in FIG. 13 of this application).

3. The enhanced refrigeration obtained in the flash, sub-cooled liquid in accordance with the present invention may, in appropriate cases, be advantageously employed by directing all or a part of the sub-cooled liquid into heat exchange relation with other process streams. By way of illustration, flash-expanded, sub-cooled liquid may be employed to partially cool or condense all or a portion of the high-pressure vapors obtained from the partially-condensed feed stream before or after expansion of the vapor stream.

4. Variations in the methods of sub-cooling may be employed; and in this respect, two or more of the sub-cooling techniques described in the examples above may be employed in combination.

5. Process flow plans and examples of the present invention have been described for convenience using shell and tube heat exchangers. In cryogenic operations, it is usually preferred to use specially designed heat exchangers such as plate-fin heat exchangers. Such special heat exchangers have improved heat transfer characteristics which may permit closer temperature approaches in the heat exchangers, lower cost, and also permit flow arrangements to accommodate heat exchange of several streams concurrently as illustrated (for example) in FIG. 11 (exchanger 160).

To summarize the foregoing, for a given demethanizer pressure and expansion ratio in prior art processing as illustrated for example in FIGS. 1 and 2, the liquid recoverable is subject to practical limitations, and often the desired recovery is greater than the recovery which can be practicably obtained in single stage gas separation plants within the available limits of pressure and expansion. To increase recovery, greater expansion ratios must be used. However, the increased expansion ratios increase the horsepower requirements of the process at increasing rates and thus economics limit the recovery normally obtained in single stage gas recovery processes.

The limitations on single stage gas recovery units have led to the use of processes having more than one separator stage for condensed liquid vapor prior to expansion for the same expansion ratio and demethanizer pressure. Two stage operation may provide in the order of two to ten percentage points improvement in ethane recovery. However, this increase is also limited and further increases cannot be obtained without prohibitive increases in horsepower requirements.

Surprisingly, we have found in the present invention that substantial increases in ethane recovery can be obtained in single stage operation without increasing expansion ratios. Indeed, as may be seen for example in comparing the ethane recovery for a typical lean gas plant of the prior art (e.g., FIG. 2) with the ethane recovery of processes in accordance with the present invention such as FIGS. 5, 6, 9, and 10, significant improvements in ethane recovery can be obtained without materially increasing the horsepower requirements of the process.

Similar improvements in ethane yield can be obtained when processing a rich gas stream, as can be seen by comparing FIGS. 3, 4, and 8 (Examples 1, 2, and 6) with FIG. 1. In FIG. 1 (a typical prior art process for such gas) ethane recovery was 72.9%, while in FIGS. 3, 4, and 8, ethane recovery from the same gas when treated in accordance with the present invention was between 92.1% and 94.8%, depending on process flow plan. The horsepower requirement in FIGS. 3, 4, and 8 was between 1224 and 1331.

The processes of FIGS. 3, 4, and 8 required more horsepower than the prior art process of FIG. 1 for treating the same gas. The increased horsepower requirement resulted because the increased recovery was withdrawn as a condensed liquid. Employing the same increased horsepower to the prior process of FIG. 1 will not provide comparable improvements in yield. This can be seen by considering the flow plan of FIG. 1 where the demethanizer is operated at a lower pressure, e.g., 250 psia instead of 290 psia. Reducing column pressure to 250 psia in the process of FIG. 1 only increases ethane recovery to 77.1%. At the same time horsepower required increased to 1315 BHP at the lower column pressure.

The choice of a particular flow plan based on the present invention will depend upon the composition of the gas to be treated. This may be seen, for example from FIG. 7 (Example 5). Where the flow plan of FIG. 7 was employed to process a lean feed gas, ethane recovery was 79.4%, and process horsepower was 1186 BHP. When the same gas processed in accordance with FIG. 2, ethane recovery was 79.1% and process horsepower was 1180 BHP. By contrast when processing a rich gas in the process of FIG. 7, ethane recovery is 88.4% and process horsepower is 1195. This contrasts with processing a rich gas following FIG. 1 where ethane recovery is 72.9 to 77.1%, and the horsepower required is 1148 to 1315 depending on column pressure.

The increased recovery of the present invention will in some circumstances require increased process horsepower (such as for recompression in compressor 22 of FIG. 1 or feed gas cooling as in exchanger 13 of FIG. 1) to provide the necessary cooling and refrigeration to condense the additional gases withdrawn from the process as a liquid. In our invention, this additional required duty can usually be supplied in a manner requiring significantly less additional horsepower than would be required in a prior art process such as FIG. 1 to increase the ethane recovery level to the same level.

As is well known, natural gas streams usually contain carbon dioxide in substantial amounts. The presence of carbon dioxide in the demethanizer can lead to icing of the column internals under cryogenic conditions. Even when the feed contains less than 1% carbon dioxide, it fractionates in the demethanizer, and can build up to concentrations of 5% to 10% or more. At such concentrations carbon dioxide can freeze out, depending on temperature, pressure, whether the carbon dioxide is in the liquid or vapor phase, and the solubility of carbon dioxide in the liquid phase.

In the present invention, it has been found that when the vapor from the high-pressure separator is expanded and supplied to the demethanizer below the top column feed position, the problem of carbon dioxide icing can be substantially mitigated. The high-pressure separator gas typically contains a large amount of methane relative to the amount of ethane and carbon dioxide. When supplied as a mid column feed, therefor, the high-pressure separator gas tends to dilute the carbon dioxide concentration, and to prevent it from increasing to icing levels.

Figure 15A:
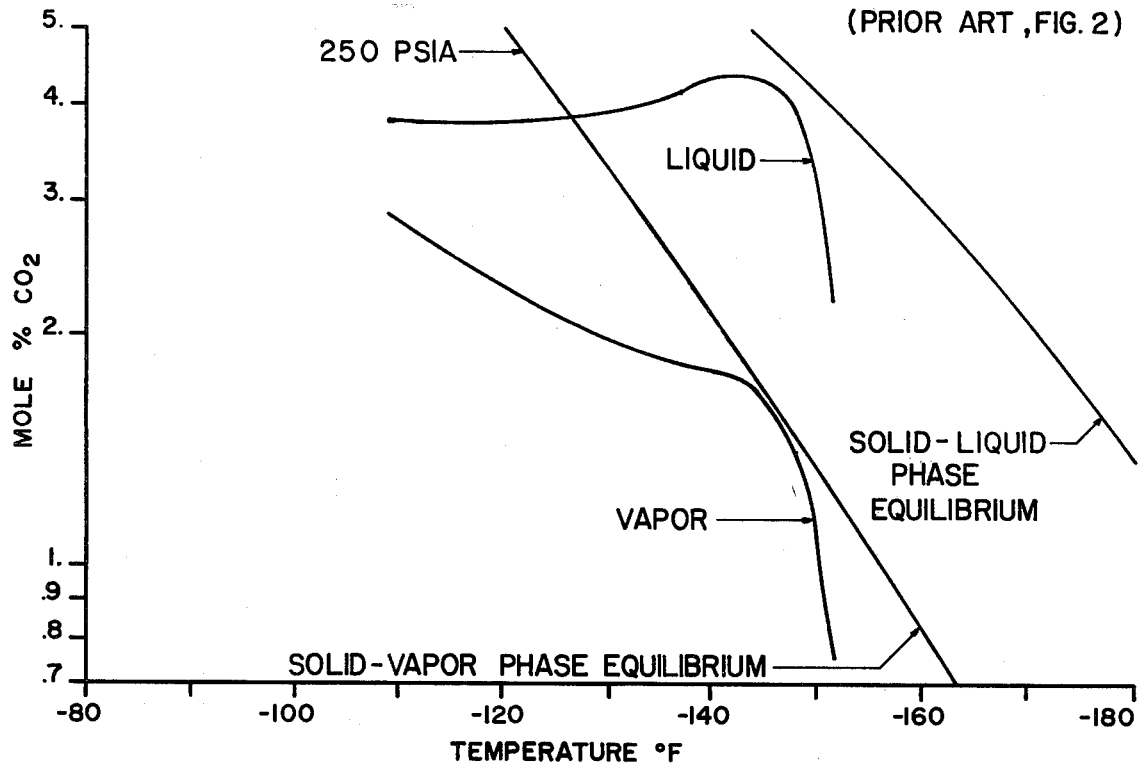
FIGS. 15A and 15B are graphs of carbon dioxide vs. temperature from one embodiment of this invention compared to the prior art.
Figure 15B:
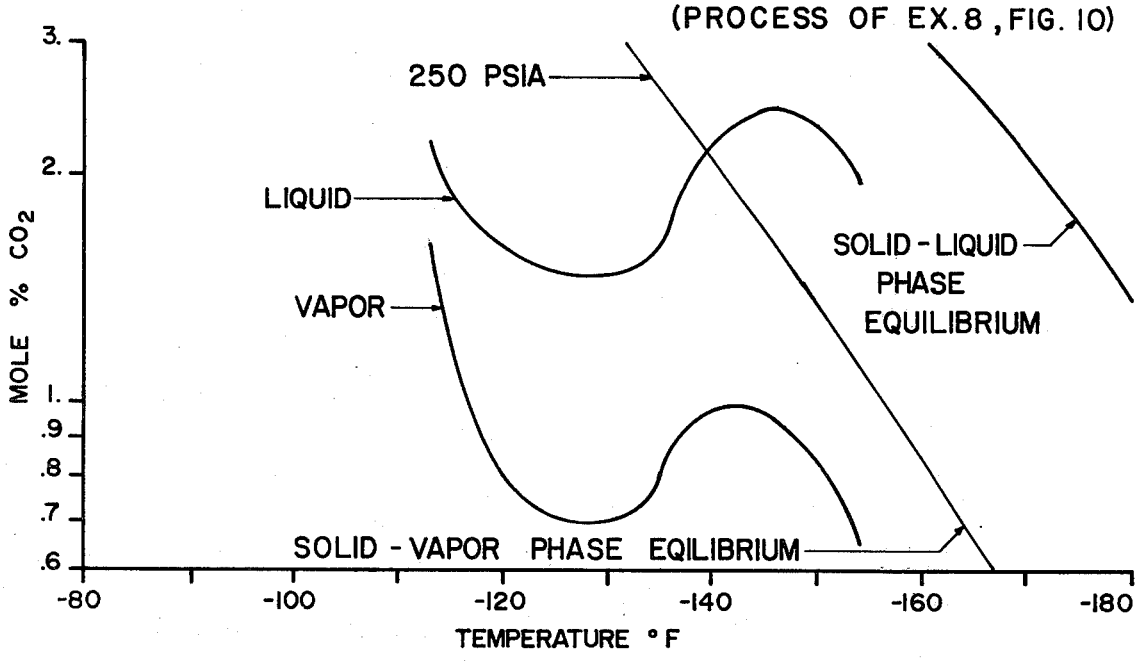

The advantage of the present invention can readily be seen by plotting carbon dioxide concentration and temperature for various trays of the demethanizer when practicing the present invention and when following the prior art. A chart thus constructed for processing the gas as described above in Example 8 (see FIG. 10 and Table X), and containing 0.72% carbon dioxide, can be compared with a similar chart constructed for the process of FIG. 2 (prior art), applied to the same gas; (see FIGS. 15A and 15B). These charts also include equilibria for vapor-solid and liquid-solid conditions. The equilibrium data given in FIGS. 15A and 15B are for the methane-carbon dioxide system. These data are generally considered representative for the methane ane ethane systems. If the $CO_2$ concentration at a particular temperature in the column is at or above the equilibrium line for that temperature, icing can be expected. For practical design purposes, the engineer will usually require a margin of safety, i.e., the actual concentration should be less than the "icing" concentration by a suitable safety factor.

As is evident, when following the prior art process of FIG. 2 (per FIG. 15A) the vapor conditions at point A touches the line representing solid-vapor phase equilibria. By contrast, in FIG. 15B, neither the vapor nor liquid conditions reach or exceed their related equilibrium conditions.

It should be noted in connection with the foregoing that when designing demethanizer columns for use in the present invention the designer will routinely verify that icing in the column will not occur. Even when vapor is fed at a mid-column position it is possible that icing may occur if the process is designed for the highest possible ethane recovery. Such designs normally call for the coldest practical temperature at the top of the column. This will result in the carbon dioxide concentration shifting to the right on the plots of FIGS. 15A and 15B. Depending on the particular application, the result can be an objectionably high concentration of carbon dioxide near the top of the column. For such a circumstance, it may be necessary to accept a somewhat lower ethane recovery to avoid column icing, or to pre-treat the feed gas to reduce carbon dioxide levels to the point where they can be tolerated in the demethanizer. In the alternative, it may be possible to avoid icing in such a circumstance by other modifications in the process conditions. For instance, it may be possible to operate the high-pressure separator at a higher temperature. This will tend to increase both the temperature of the expanded vapor stream as well as the amount of it. If this can be done within the limitations of the process heat balance, icing may be avoided without losing ethane recovery.

In connection with the foregoing description of our invention, it should be noted in some embodiments the feed to the top of the demethanizer is wholly or partially a liquified portion of vapors from the high-pressure separator (see, for instance, FIGS. 13 and 14) which is flash expanded to the demethanizer pressure. In some cases it may be advantageous to provide for auto-cooling of this stream. This may be accomplished by dividing the liquified high-pressure vapor into two streams either before or after expansion. (If the vapor is divided before expansion, both parts are expanded). Thereafter, one of the two divided streams after expansion is directed into a heat exchange relation to the high-pressure vapor prior to expansion.

We claim:

1. In a process for separation a feed gas into a volatile residue gas and a relatively less volatile fraction, said feed gas containing hydrocarbons, methane and ethane together comprising the major portion of said feed gas, wherein said gas under pressure is cooled sufficiently to form a liquid portion under pressure and a vapor portion under pressure, and (i) said vapor portion under pressure is expanded to a lower pressure, whereby it partially condenses, (ii) said liquid portion under pressure is expanded to said lower pressure, whereby a part of said liquid portion vaporizes to cool the expanded liquid portion; and (iii) at least the liquid formed upon partial condensation of said expanded vapor, and the remaining liquid portion of said expanded liquid stream are supplied to a fractionation column wherein said relatively less volatile fraction is separated, the improvement wherein (a) at least some of said liquid portion under pressure is subcooled to a temperature below its bubble point prior to expansion thereof, (b) at least a part of said subcooled liquid portion is expanded to said lower pressure, whereby a portion of the expanded subcooled stream is partially vaporized to further cool said expanded subcooled stream, and (c) at least a portion of the liquid remaining in the expanded subcooled stream is supplied to said distillation column as a top liquid feed thereto.

2. The improvement according to claim 1, wherein the liquid obtained by partial condensation in step (i) is supplied to said fractionation column as an additional top column feed.

3. The improvement according to claim 1, wherein the liquid obtained from partial condensation of said vapor portion in step (i) is combined with the liquid remaining from expansion of said subcooled liquid in step (b) to form a combined liquid stream;

said combined liquid stream is divided into a first part and a remaining part, the first part of said combined liquid stream is directed into heat exchange relation with at least some of said liquid portion under pressure, whereby said subcooled liquid portion is obtained and said combined stream is partially vaporized, said partially vaporized first part is supplied to said fractionation column at a mid column feed position, and the remaining part of said combined liquid stream is supplied to said fractionation column as the top liquid feed.

4. The improvement according to claim 1, wherein the liquid remaining from expansion of said subcooled liquid portion in step (b) is divided into a first part and a remaining part, and said first part is directed into heat exchange relation with at least some of said liquid portion under pressure, whereby said subcooled liquid portion is obtained and said first part is at least partially vaporized, said first part is thereafter supplied to said fractionation column at a mid column feed position, and said remaining part is supplied to said fractionation column as a top column liquid feed.

5. The improvement according to claim 1, wherein said subcooled liquid portion from step (a) is divided into a first part and a remaining part, said first part is expanded to said lower pressure and directed into heat exchange relationship with at least some of said liquid portion under pressure, whereby said subcooled liquid portion is obtained, said expanded first part leaving said heat exchange relation is thereafter supplied to said fractionation column at a mid column feed position, and said remaining part of said subcooled liquid is expanded and supplied to said fractionation column as a top column liquid feed.

6. The improvement according to claim 1, wherein the expanded vapor portion obtained in step (i) is supplied to said fractionation column at a mid column feed position.

7. The improvement according to claim 1, wherein at least some of said liquid portion under pressure is subcooled by extracting heat therefrom, and said heat is supplied to said fractionation column at a mid column position in said fractionation column, whereby said subcooled liquid portion under pressure is obtained.

8. The improvement according to claim 7, wherein a liquid side stream is withdrawn from said fractionation column at a mid column position and directed into heat exchange relation with at least some of said liquid portion under pressure.

9. The improvement according to claim 1, wherein at least some of said liquid portion under pressure is directed into heat exchange relation with cold volatile residue gas, whereby said subcooled liquid portion is obtained, and said cold volatile residue gas is warmed.

10. The improvement according to claim 1, wherein at least some of said expanded vapor portion obtained in step (i) is directed into heat exchange relation with at least some of said liquid portion under pressure, whereby said subcooled liquid portion is obtained.

11. In a process for separating a feed gas into a volatile residue gas and a relatively less volatile fraction, said feed gas containing hydrocarbons, methane and ethane together comprising the major portion of said feed gas, wherein said gas under pressure is cooled sufficiently to form a liquid portion under pressure and a vapor portion under pressure, and (i) said vapor portion under pressure is expanded to a lower pressure, whereby it partially condenses;

(ii) said liquid portion under pressure is expanded to said lower pressure, whereby a part of said liquid portion vaporizes to cool the expanded liquid portion; and (iii) at least the liquid formed upon partial condensation after expansion of the vapor portion in step (i) and the liquid remaining after expansion of the liquid portion in step (ii) are supplied to a fractionation column, wherein said relatively less volatile fraction is separated, the improvement wherein (a) at least some of said liquid portion under pressure is cooled to a temperature below its bubble point prior to expansion thereof, (b) at least part of said subcooled liquid portion is expanded to said lower pressure, whereby it is partially vaporized to cool said expanded liquid portion, (c) at least part of the liquid remaining in the expanded liquid portion is supplied to said distillation column at a first feed position, and (d) at least part of the stream resulting from expansion of said vapor in step (i) is supplied to said fractionation column at a second feed position, said second feed position being in a lower column position than said first feed position.

12. In an apparatus for separating a feed gas into a volatile residue gas and a relatively less volatile fraction, said feed gas containing hydrocarbons, methane and ethane together comprising the major portion of said feed gas, said apparatus including (i) a first cooling means to receive said feed gas under pressure and to cool it sufficiently to form a liquid portion and a vapor portion, (ii) a separation means connected to said first cooling means to separate said liquid portion under pressure and said vapor portion under pressure, (iii) first expansion means connected to the separation means to receive said vapor portion under pressure and expand it to a lower pressure, thereby partially condensing said expanded vapor stream, (iv) a second expansion means connected to receive said liquid portion under pressure and to expand said liquid portion to said lower pressure, thereby to vaporize a portion of said liquid and to cool the expanded liquid portion, and (v) a fractionation means connected to said first and second expansion means to receive at least the liquid formed from partial condensation of said expanded vapor and the liquid remaining from expansion of said liquid stream, to separate said relatively less volatile fraction, the improvement comprising (a) a subcooling means connected intermediate said separation means and said second expansion means to cool said liquid portion under pressure to a temperature below its bubble point prior to expansion thereof, said subcooling means being connected to supply at least a portion of said subcooled liquid to said second expansion means, and (b) said second expansion means is connected to supply at least part of the liquid remaining in the expanded subcooled liquid portion to said distillation column as a top liquid feed thereto.

13. The improvement according to claim 12, wherein there are provided connection means connected to said first expansion means to supply expanded stream produced by said first expansion means to said fractionation column as an additional top column feed.

14. The improvement according to claim 12, wherein there is provided (1) a second separation means connected intermediate said second expansion means and said distillation column to receive the expanded subcooled liquid portion from said second expansion means, said second separation means further being connected to receive the expanded vapor portion from said first expansion means, said second separation means providing thereby a combined liquid stream, (2) means connecting said second separation means to said subcooling means to receive a portion of the combined liquid stream from said second separation means and to direct a portion of said combined liquid to said subcooling means for indirect heat exchange with said liquid portion under pressure, whereby said subcooling means cools said liquid portion under pressure to a temperature below its bubble point prior to expansion thereof, and said portion of the combined liquid stream is warmed, (3) means connecting said subcooling means to said fractionation column at a mid column feed position to supply said portion of the combined liquid stream to said fractionation column as a mid column feed, and (4) further connecting means connected between said second separation means and said fractionation column to supply the remaining part of said combined liquid stream to said fractionation column as the top liquid feed thereto.

15. The improvement according to claim 12, wherein there are provided (1) a dividing means connected intermediate said second expansion means and said distillation column to receive the liquid remaining in the expanded liquid portion produced in said second expansion means, (2) means connecting said dividing means to said subcooling means to direct a first part of the expanded subcooled liquid portion to said second cooling means, wherein said expanded subcooled liquid portion is directed into heat exchange relation with said liquid portion under pressure to subcool said liquid portion under pressure and warm the first part of said expanded subcooled liquid portion, (3) means connecting said subcooling means to said fractionation column to receive warmed first part from said second cooling means and direct it to said fractionation column at a mid column feed position, and (4) means connected to said dividing means to receive the remaining part of said expanded subcooled liquid portion and supply it to said fractionation column as a top column liquid feed.

16. The improvement according to claim 12, wherein there are provided (1) dividing means connected intermediate said subcooling means and said second expansion means to receive subcooled liquid portion from said second cooling means and to divide it into a first part and a second part, (2) a third expansion means connected to said dividing means to receive said first part of said subcooled liquid portion and to expand it to said lower pressure, said third expansion means further being connected to supply said expanded first part to said subcooling means wherein said expanded first part passes into heat exchange relation with said liquid portion under pressure to subcool said liquid portion, (3) means connected between said second cooling means to receive said expanded first part therefrom and to supply it to said fractionation column at a mid column feed position, and (4) means connected to said dividing means to receive said second part of said subcooled liquid portion and supply it to said second expansion means, whereby said remaining part is expanded to said lower pressure and supplied to said distillation column as a top liquid feed thereto.

17. The improvement according to claim 12, including means connected to said first expansion means (iii) to receive said expanded vapor portion and to supply said expanded vapor portion to said fractionation column at a mid column feed position.

18. The improvement according to claim 12, wherein said subcooling means comprises means to extract heat from said liquid portion under pressure and to supply said heat to said fractionation column at a mid column position.

19. The improvement according to claim 18, wherein said means to extract heat comprise means to withdraw a side stream from said fractionation column at a mid column position and direct said side stream into heat exchange relation with said liquid portion under pressure in said subcooling means, and means to return said side stream from said subcooling means to said fractionation column.

20. The improvement according to claim 12, wherein there are provided means to direct cold volatile residue gas to said subcooling means, and into heat exchange relation with said liquid portion under pressure in said second cooling means, whereby said liquid portion under pressure is subcooled and said cold volatile residue gas is warmed.

21. The improvement according to claim 2, wherein there are provided means connected between said first expansion means and said subcooling means to receive said expanded vapor portion and direct it into heat exchange relation with said liquid portion under pressure, whereby said liquid portion under pressure is subcooled.

22. In an apparatus for separating a feed gas into a volatile residue gas and a relatively less volatile fraction, said feed gas containing hydrocarbons, methane and ethane together comprising the major portion of said feed gas, said apparatus including (i) a first cooling means to receive said feed gas under pressure and to cool it sufficiently to form a liquid portion and a vapor portion, (ii) separation means connected to said cooling means to separate said liquid portion under pressure and said vapor portion under pressure, (iii) a first expansion means connected to said separation means to receive said vapor portion under pressure and expand it to a lower pressure, thereby partially condensing said expanded vapor portion, (iv) a second expansion means connected to receive said liquid portion under pressure and to expand said liquid portion to said lower pressure, thereby to vaporize a portion of said liquid and to cool the expanded liquid portion, and (v) a fractionation means connected to said first and second expansion means to receive at least the liquid formed from partial condensation of said expanded vapor and the liquid remaining from expansion of said liquid stream to separate said relatively less volatile fraction, the improvement comprising (a) a subcooling means connected intermediate said separation means and said second expansion means to cool said liquid portion under pressure to a temperature below its bubble point prior to expansion thereof, said second cooling means being connected to supply at least a portion of said subcooled liquid to said second expansion means, (b) said second expansion means being connected to supply at least a part of the liquid remaining in the expanded subcooled liquid portion to said distillation column at a first column feed position, and (c) said first expansion means being connected to provide at least a part of the expanded vapor stream to said fractionation column at a second feed position, said second feed position being in a lower column position than said first feed position.

* * * * *